US006242681B1

(12) United States Patent
Daishoji

(10) Patent No.: US 6,242,681 B1
(45) Date of Patent: Jun. 5, 2001

(54) WAVEFORM REPRODUCTION DEVICE AND METHOD FOR PERFORMING PITCH SHIFT REPRODUCTION, LOOP REPRODUCTION AND LONG-STREAM REPRODUCTION USING COMPRESSED WAVEFORM SAMPLES

(75) Inventor: Takeshi Daishoji, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/447,204

(22) Filed: Nov. 22, 1999

(30) Foreign Application Priority Data

Nov. 25, 1998 (JP) ..... 10-333761
Nov. 25, 1998 (JP) ..... 10-333762
Nov. 25, 1998 (JP) ..... 10-333763

(51) Int. Cl.[7] ..... G10H 7/02
(52) U.S. Cl. ..... 84/604
(58) Field of Search ..... 84/603–607, 622–625

(56) References Cited

U.S. PATENT DOCUMENTS 5,086,475 * 2/1992 Kutaragi et al. ..... 84/603 X
5,298,671 * 3/1994 Bliss ..... 84/603
5,430,241 * 7/1995 Furuhashi et al. ..... 84/603
5,872,727 * 2/1999 Kuo ..... 84/603 X
5,877,446 * 3/1999 Monahan et al. ..... 84/603
5,886,277 * 3/1999 Takauji ..... 84/604
5,890,126 * 3/1999 Lindemann ..... 84/603 X

* cited by examiner

*Primary Examiner*—Stanley J. Witkowski
(74) *Attorney, Agent, or Firm*—Morrison & Foerster

(57) ABSTRACT

Compressed waveform samples are read out from a memory on the basis of progressive phase information corresponding to a tone pitch. Readout controller controls the readout so as to provide successive compressed waveform samples from the one corresponding to the phase information of a last sampling cycle to the one corresponding to the phase information of a current sampling cycle. Thus, irrespective of the pitch, all the samples existing between the last sampling cycle and the current sampling cycle are read out. Each of the readout samples is decoded and the thus-decoded sample is used as a prediction value for decoding the following sample, so that all the successive compressed waveform samples can be decoded. As the actual sample corresponding to the current sampling cycle, a necessary sample corresponding to the current phase information is selected from among the decoded samples. Loop reproduction is performed by repeating the advance of the phase information between loop start and end locations. Sample generated by decoding the compressed waveform sample corresponding to the loop start location is stored, and when the advance of the loop readout returns from the loop end location to the loop start location, the stored sample is provided as the prediction value for decoding. Long-stream reproduction is carried out by writing, into memory, partial long-stream data and repeating read and write of the partial long-stream on a region of the memory.

44 Claims, 16 Drawing Sheets

| | 15–12 | 11–8 | 7–4 | 3–0 |
|---|---|---|---|---|
| 100 | D(3) | D(2) | D(1) | D(0) |
| 101 | D(7) | D(6) | D(5) | D(4) |
| 102 | – | D(A) | D(9) | D(8) |

SDEC & SELECTION SIGNAL ( SEL )

| | SEL | $S_0$ | $S_1$ |
|---|---|---|---|
| SDEC1 | B | PRECEDING-BLOCK RAM | PRECEDING-BLOCK RAM |
| SDEC2 | D | ↑ | TO-BE-CURRENTLY-DECODED BLOCK |
| SDEC3 | A | TO-BE-CURRENTLY-DECODED BLOCK | ↑ |
| SDEC5 | C | LOOP-START-BLOCK RAM | LOOP-START-BLOCK RAM |
| SDEC6 | D | ↑ | TO-BE-CURRENTLY-DECODED BLOCK |
| SDEC7 | A | TO-BE-CURRENTLY-DECODED BLOCK | ↑ |

FIG. 13

SDEC/DS & LATCH TIMING

<SDEC1>

| | $S_0$ ( LAST ) | $S_1$ ( LAST ) |
|---|---|---|
| DS0 | TIM1 | TIM3 |
| DS1 | TIM3 | TIM5 |
| DS2 | TIM5 | TIM7 |

<SDEC2>

| | $S_0$ ( LAST ) | $S_1$ ( NEW ) |
|---|---|---|
| DS3 | TIM1 | TIM1 |

<SDEC3>

| | $S_0$ ( NEW ) | $S_1$ ( NEW ) |
|---|---|---|
| DS0 | TIM1 | TIM3 |
| DS1 | TIM3 | TIM5 |
| DS2 | TIM5 | TIM7 |

<SDEC5>

| | $S_0$ ( LOOP ) | $S_1$ ( LOOP ) |
|---|---|---|
| DS0 | TIM1 | TIM3 |
| DS1 | TIM3 | TIM5 |
| DS2 | TIM5 | TIM7 |

<SDEC6>

| | $S_0$ ( LOOP ) | $S_1$ ( NEW ) |
|---|---|---|
| DS3 | TIM1 | TIM1 |

<SDEC7>

| | $S_0$ ( NEW ) | $S_1$ ( NEW ) |
|---|---|---|
| DS0 | TIM1 | TIM3 |
| DS1 | TIM3 | TIM5 |
| DS2 | TIM5 | TIM7 |

FIG. 14

WAVEFORM REPRODUCTION DEVICE AND METHOD FOR PERFORMING PITCH SHIFT REPRODUCTION, LOOP REPRODUCTION AND LONG-STREAM REPRODUCTION USING COMPRESSED WAVEFORM SAMPLES

BACKGROUND OF THE INVENTION

The present invention relates to a waveform reproduction device and method capable of reproducing, in a pitch-shifted condition (i.e., with a pitch shift), compressed waveform samples stored in memory in the form of differential code or adaptive differential code. The present invention also relates to a waveform reproduction device and method capable of reproducing compressed tone waveform samples in a loop fashion by repetitively reading out part of the tone waveform samples from memory. The present invention further relates to a waveform reproduction device and method capable of reproducing a long stream of compressed tone waveform samples stored in memory.

PCM (Pulse Code Modulation) tone generators have been known, which prestore actual musical instrument tones into a waveform memory after subjecting them to PCM processing and, at the time of a performance, reproduce desired musical instrument tones by reading out the pulse-code-modulated tone waveform sample data from the waveform memory. Among examples of the conventionally-known schemes for reading out the tone waveform sample data in a pitch-shifted condition in these PCM tone generators are the so-called pitch-synchronized readout and the non-pitch-synchronized readout. The pitch-synchronized-type PCM tone generators (i.e., PCM tone generators based on the pitch-synchronized readout) are arranged to count clock pulses of a frequency corresponding to a tone pitch to be reproduced and access the waveform memory in accordance with the current clock pulse count, in cycles corresponding to the memory address values, to sequentially read out the tone waveform sample data from the memory one by one. These pitch-synchronized-type PCM tone generators can advantageously minimize non-harmonious aliasing noise because the sampling frequency defining an output rate varies in accordance with the pitch. However, with the pitch-synchronized-type PCM tone generators, problems pertaining to tonal quality would occur, because the formant (tone color) is expanded or compressed depending on the pitch to thereby cause a variation in the tone color in accordance with the reproduced pitch and also time-divisional multiplexed processing is difficult to carry out due to the sampling frequency variation. Thus, the pitch-synchronized-type PCM tone generators have the drawback that a plurality of tones can not be reproduced appropriately (without a hitch) at low costs.

The non-pitch-synchronized-type PCM tone generators (i.e., PCM tone generators based on the non-pitch-synchronized readout), on the other hand, are arranged to accumulate frequency information of a numerical value corresponding to the reproduced pitch every predetermined cycle (at a predetermined output rate) and generate a memory address corresponding to each current accumulated result so as to access the waveform memory to read out the tone waveform sample data therefrom. Because the sampling frequency defining the output rate is fixed in these non-pitch-synchronized-type PCM tone generators, the formant (tone color) does not vary despite a pitch variation and no tone color variation would occur even when the reproduction pitch changes. Further, because of the fixed sampling frequency, time-divisional multiplexed processing can be executed easily, so that a plurality of tones can be reproduced appropriately at low costs. However, the non-pitch-synchronized-type PCM tone generators have the drawback that the fixed sampling frequency would lead to undesired non-harmonious aliasing noise would occur due to the fixed sampling frequency. Nevertheless, all things considered, the non-pitch-synchronized-type PCM tone generators are more advantageous over the pitch-synchronized-type PCM tone generators and thus are being popularly used as the mainstream of the today's PCM tone generators.

However, because all PCM tone waveform samples are stored in the waveform memory just as they are, the conventional PCM tone generators would require a greater storage capacity of the waveform memory as the number of the tone colors of the tone waveform samples increases.

If the number of bits per tone waveform sample is reduced through data compression, then it would be possible to store the necessary tone waveform samples without the need to increase the storage capacity of the waveform memory. Typically, the tone waveform samples can be converted into compressed tone waveform samples through, for example, differential pulse code modulation (commonly known as "DPCM") or adaptive differential pulse code modulation (commonly known as "ADPCM"). The DPCM and ADPCM coding schemes compress each of the tone waveform samples using a prediction value generated on the basis of the preceding tone waveform sample value; namely, decoding each of the compressed tone waveform samples requires, as a prediction value, decoded waveform samples generated by decoding the preceding compressed tone waveform sample. But, in the tone generators of the non-pitch-synchronized type, some of the compressed tone waveform samples tend to be skipped (fail to be read) when the pitch gets high; thus, the preceding compressed tone waveform samples can not be read out sequentially one by one, which presents the problem that the decoding can not be performed.

Further, in the PCM tone generators entire PCM, which are designed to store PCM tone waveform samples in the waveform memory just as they are, all tone waveform samples of a sustain tone, such as a brass or stringed instrument tone, from the start to end of the waveform can not be stored in the waveform memory due to a limited storage capacity of the memory, unlike a tone of relatively short duration, such as a percussion instrument tone. Therefore, to audibly reproduce a tone whose all tone waveform samples can not be stored in the waveform memory, there has been used a "loop reproduction" technique which reproduces the tone waveform samples in a loop fashion by repetitively reading out part of the tone waveform samples from the waveform memory.

However, even where the loop reproduction is performed, a greater storage capacity of the waveform memory is required as the number of the tone colors increases, so that there arises a need to reduce the sizes of memory areas to be allocated for individual tones. The reduced memory area sizes would create a possibility of degrading the quality of the reproduced tones. Reducing the number of bits per tone waveform sample through data compression would allow the tone waveform samples of a relatively long tone to be stored in the memory area of a limited capacity. To compress the tone waveform samples, the differential pulse code modulation (DPCM) or adaptive differential pulse code modulation (ADPCM) may be used as mentioned above, which uses a prediction value generated on the basis of the preceding tone waveform value, so that, in decoding each of the compressed tone waveform samples, decoded waveform samples, generated by decoding the preceding compressed tone waveform sample, is required as a prediction value. Namely, in this case, the tone waveform samples compressed through the DPCM or ADPCM can not be decoded unless all these samples are read out sequentially one by one. When the loop reproduction is effected, however, the reproduction, upon arrival at the loop end, must loop back to the loop start location; this means that the reproduction is caused to always loop back to a particular compressed tone waveform sample at some mid point of the waveform and thus all the compressed tone waveform samples can not be decoded from the beginning of the waveform.

Further, even in the case where the allocated memory area has a limited capacity as mentioned earlier, the loop reproduction technique can appropriately reproduce a sustain tone. However, the loop reproduction technique can not appropriately reproduce a tone of relatively long duration, such as a background music sound, using such a capacity-limited memory area. Hereinafter, the function of reproducing a tone of relatively long duration will be referred to as a "long-stream reproduction" function.

Thus, in order to provide a waveform reproduction device with the long-stream reproduction function, it has been proposed to equip the reproduction device with a separate data input terminal for long-stream reproduction so that mixing is made between tone waveform samples of the long stream applied to that input terminal and tone waveform samples reproduced by the tone reproduction function and the mixed results are sequentially supplied to a digital-to-analog (D/A) converter. But, the proposed long-stream reproduction technique must feed the long stream of tone waveform samples from the outside to the reproduction device in synchronism with a reproduction rate of the reproduction device, which would unavoidably impose great loads on a higher-order device that supplies the long stream of tone waveform samples.

Further, because the long stream of tone waveform samples necessary for reproducing a tone of relatively long duration contains an enormous quantity of data, a storage device for storing such a long stream needs to have a great capacity. Thus, as one approach to permit appropriate reproduction of such a relatively long tone by use a storage device of limited capacity, it has been proposed that the long stream of tone waveform samples be converted into compressed code format to thereby store the resultant compressed tone waveform samples in the storage device and the long-stream reproduction function be used to read out the compressed tone waveform samples. But, with this proposed approach too, it is necessary for the higher-order device to feed the compressed tone waveform samples from the outside to the reproduction device in synchronism with the reproduction rate of the reproduction device. Further, this approach requires a separate decoder dedicated to reproducing the long stream, thus unavoidably resulting in increased costs.

SUMMARY OF THE INVENTION

It is therefore an object of the present invention to provide a waveform reproduction device and method which, even where they are arranged as the non-pitch-synchronized type having compressed tone waveform samples stored in a waveform memory, are capable of appropriately reproducing the compressed tone waveform samples with a desired pitch shift.

It is another object of the present invention to provide a waveform reproduction device and method which, even where they use a waveform memory storing compressed tone waveform samples with the number of bits per sample substantially reduced, are capable of appropriate loop reproduction of the compressed tone waveform samples.

It is still another object of the present invention to provide a waveform reproduction device and method which are capable of appropriately reproducing a long stream of tone waveform samples by use of a waveform sample storage storing the tone waveform samples in a memory area of a limited capacity and which also can significantly lessen loads on a higher-order device supplying the long stream.

It is yet another object of the present invention to provide a waveform reproduction device and method which can appropriately reproduce a long stream of compressed tone waveform samples without a decoder dedicated to the long-stream reproduction.

In order to accomplish the aforementioned object pertaining to the pitch shift reproduction, the present invention provides a waveform reproduction device which comprises: a memory that stores compressed waveform samples based on a predetermined data compression scheme; a phase generator that generates, every sampling cycle, progressive phase information varying in accordance with a tone pitch to be reproduced; a readout controller that sequentially reads out the compressed waveform samples from the memory on the basis of the phase information generated by the phase generator, the readout controller controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle; a compression decoder that decodes each of the compressed waveform samples read out from the memory using a predetermined prediction value; a buffer that supplies the compression decoder with a previously decoded waveform sample as the predetermined prediction value, to thereby allow the compression decoder to decode all the compressed waveform samples read out from the memory; and an output section that selects and outputs, from among the waveform samples decoded by the compression decoder, a decoded waveform sample corresponding to the phase information of the current sampling cycle.

In a situation where the tone pitch to be reproduced is higher than the original pitch of the compressed waveform samples stored in the memory, an incomplete succession would occur between the compressed waveform sample of the last sampling cycle and the compressed waveform sample of the current sampling cycle, involving a skip or omission corresponding to an amount of pitch-up shift of the to-be-reproduced pitch relative to the original pitch. For example, a pitch-up shift across one octave would advance the phase by two samples per sampling cycle and consequently skip just one sample, and a pitch-up shift across two octaves would advance the phase by four samples per sampling cycle and consequently skip three samples. As stated earlier in relation to the prior art, such a skip of the compressed waveform samples to be read out would make it impossible to decode the compressed waveform sample using the prediction method.

Therefore, the present invention is arranged to eliminate the inconveniences by controlling the readout, from the memory, of the compressed waveform samples so as to provide successive compressed waveform samples from the one corresponding to the phase information generated in the last sampling cycle to the other one corresponding to the phase information generated in the current sampling cycle. Namely, the present invention is constructed to also read out all the intermediate compressed waveform samples, which exist between the compressed waveform sample corresponding to the phase information of the last sampling cycle and the compressed waveform sample corresponding to the phase information of the current sampling cycle and which used to be undesirably skipped with the conventional readout technique based only on progressive phase information corresponding to a to-be-reproduced pitch; thus, the present invention can read out all the successive compressed waveform samples present between the last sampling cycle and the current sampling cycle. Each of the read-out compressed waveform samples is decoded using a prediction value and the thus-decoded waveform sample is used as the prediction value for decoding the following sample, so that all the successive compressed waveform samples can be decoded or decompressed (i.e., expanded). As the actual waveform sample corresponding to the current sampling cycle, any necessary sample corresponding to the current phase information may be selected and output from among the decoded waveform samples.

Thus, according to the present invention, compressed waveform samples read out with a pitch-up shift in a waveform reproduction device, where compressed waveform samples are each stored in memory in a reduced number of bits, can be appropriately decoded or decompressed and reproduced at a desired pitch. Further, the phase generator may generate the progressive phase information by calculating (accumulating in typical cases), every predetermined sampling cycle, a phase variation value corresponding to the tone pitch to be reproduced; such arrangements provide for waveform reproduction of the non-pitch-synchronized type. Thus, even in a non-pitch-synchronized-type waveform reproduction device using compressed waveform samples, the present invention allows compressed waveform samples, read out with a pitch-up shift, to be appropriately decoded or decompressed and reproduced at a desired pitch.

In one implementation, the above-mentioned buffer may include a storage for temporarily storing at least one of the waveform samples decoded by the compression decoder. Alternatively, the buffer may include a storage for temporarily storing a latest (most recent) one of the waveform samples decoded by the compression decoder. Further, the readout controller may control the readout of the compressed waveform samples so that all the compressed waveform samples existing between the one compressed waveform sample corresponding to the phase information of the last sampling cycle and the other one corresponding to the phase information of the current sampling cycle are read out from the memory at least by the current sampling cycle. Furthermore, the readout controller may control the readout of the compressed waveform samples in such a manner that a plurality of the compressed waveform samples before and/or after the compressed waveform sample corresponding to the phase information of the current sampling cycle are read out in the current sampling cycle. Moreover, the readout controller may read out, from the memory, successive compressed waveform samples that amount to a particular number defined on the basis of both the phase information generated by the phase generator in the current and last sampling cycles.

In a preferred implementation, the memory has stored therein n, which is an integral number of two or over, successive compressed waveform samples per address, and the readout controller performs, every sampling cycle, either control for reading out the n compressed waveform samples from the memory by accessing one address of the memory in accordance with the phase information or control for not accessing the memory at all. Further, the compression decoder decodes the n compressed waveform samples read out from the memory in one sampling cycle, and the buffer includes a storage for storing n decoded waveform samples output by the compression decoder at least till a next sampling cycle. The n decoded waveform samples stored in the storage are usable as the prediction value for decoding by the compression decoder in the next sampling cycle and also selectable as waveform samples to be output via the output section in response to the phase information of the next sampling cycle. With such arrangements, the compressed waveform data, each having a reduced number of bits, can be efficiently crammed into the respective memory addresses, which achieves an efficient use of the memory. Further, the number of access to the memory can be minimized, with the result that the loads involved in the readout control can be effectively lessened.

Further, the total number of the compressed waveform samples which can be read out, by the readout controller, from the memory per sampling cycle may be n that is an integral number of two or over, and the upper limit to a pitch-up process for reproducing a waveform of a higher pitch than the original pitch of the waveform stored in the memory may be controlled in accordance with the number n. The loads involved in the readout control can be effectively lessened by thus limiting the number of samples to be read out per sampling cycle to "n" while assuring a necessary pitch-up shift amount.

In a preferred embodiment, the phase information generated by the phase generator is composed of an integer portion and a decimal fraction portion, and the output section may select at least two of the waveform samples on the basis of the integer portion of the phase information and may perform interpolating arithmetic operations, in accordance with the decimal fraction portion of the phase information, using the thus-selected at least two waveform samples, to thereby generate the waveform sample corresponding to the phase information of the current sampling cycle. Such arrangements can effectively enhance the pitch reproducing accuracy and resolution of a reproduced waveform.

Furthermore, the compressed waveform samples stored in the memory are compression-coded on the basis of a differential pulse code modulation (DPCM) scheme or an adaptive differential pulse code modulation (ADPCM) scheme. Moreover, the waveform reproduction device of the present invention may be arranged to be able to reproduce a plurality of waveforms by time-divisionally decoding the compressed waveform samples in a plurality of reproduction channels. Particularly, even in a non-pitch-synchronized-type waveform reproduction device using compressed waveform samples, the present invention can appropriately carry out readout of the waveform samples with a pitch-up shift and hence can be suitably used to reproduce waveforms in a plurality of channels on the time-divisional basis.

In order to accomplish the aforementioned object pertaining to the loop reproduction, the present invention provides a waveform reproduction device which comprises: a memory that stores compressed waveform samples based on a predetermined data compression scheme; a readout controller that generates an address signal advancing at a given reproduction rate in order to read out the compressed waveform samples from the memory, the readout controller controlling loop readout of the compressed waveform samples by repeating an advance of the address signal between a given loop start location and a given loop end location; a compression decoder that decodes each of the compressed waveform samples read out from the memory, using a prediction value; and a storage that stores a waveform sample generated by the compression decoder decoding the compressed waveform sample corresponding to the loop start location. When the advance of the address signal returns from the loop end location to the loop start location, the storage supplies the stored waveform sample to the compression decoder for use as the prediction value.

By thus storing the waveform sample generated by the compression decoder decoding the compressed waveform sample corresponding to the loop start location and supplying the stored waveform sample to the compression decoder, for use as the prediction value, when the advance of the address signal returns from the loop end location to the loop start location, the decoding (decompression) by the compression decoder would never be adversely influenced even when the read address jumps during a loopback, because the compression decoder at that time is allowed to use, as the prediction value, the stored decoded waveform sample corresponding to the loop start location. Consequently, even in a waveform reproduction device of the type where compressed waveform samples, each having a reduced number of bits, are stored in memory, the present invention can appropriately reproduce a waveform through loop reproduction.

In order to accomplish the object, the present invention also provides a waveform reproduction device which comprises: a memory that stores compressed waveform samples based on a predetermined data compression scheme; a phase generator that generates, every sampling cycle, progressive phase information varying in accordance with a tone pitch to be reproduced, the phase generator controlling loop reproduction by repeating an advance of the phase information between a given loop start location and a given loop end location; a readout controller that sequentially reads out the compressed waveform samples from the memory on the basis of the phase information generated by the phase generator, the readout controller controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle; a compression decoder that decodes each of the compressed waveform samples read out from the memory, using a predetermined prediction value; a buffer that supplies the compression decoder with a previously decoded waveform sample as the predetermined prediction value, to thereby allow the compression decoder to decode all the compressed waveform samples read out from the memory; and a storage that stores a waveform sample generated by the compression decoder decoding the compressed waveform sample corresponding to the loop start location. When the advance of the phase information returns from the loop end location to the loop start location, the storage supplies the stored waveform sample to the compression decoder for use as the prediction value. The waveform reproduction device also includes an output section for selecting and outputting, from among the waveform samples decoded by the compression decoder, a decoded waveform sample corresponding to the phase information of the current sampling cycle.

The invention arranged in the above-mentioned manner can implement both pitch shift reproduction and loop reproduction using the aforementioned compressed waveform samples. In this case too, the progressive phase information may be generated by calculating (accumulating in typical cases), every predetermined sampling cycle, a phase variation value corresponding to the tone pitch to be reproduced. Such arrangements provide for waveform reproduction of the non-pitch-synchronized type. Thus, even in a non-pitch-synchronized-type waveform reproduction device using compressed waveform samples, the present invention, irrespective of the pitch at which the tone is to be reproduced, can carry out a predetermined loop reproduction between predetermined loop start and end locations while appropriately decoding (decompressing) the compressed waveform samples. Further, the present invention can also be suitably used in performing the loop reproduction while time-divisionally reproducing tones in a plurality of channels, so that it can appropriately reproduce a plurality of tones at low costs.

In order to accomplish the aforementioned object pertaining to the long-stream reproduction, the present invention provides a waveform reproduction device which comprises: a readable and writable memory that stores partial long-stream data constituting part of a long stream of sound waveform samples; a readout controller that generates an address signal advancing at a given reproduction rate in order to read out the waveform samples from the memory, the readout controller repeating an advance of the address signal between a start location and an end location of a particular region of the memory which stores the partial long-stream data, to thereby perform loop readout of the region; and a memory rewrite controller that, before the advance of the address signal returns from the end location to the start location, rewrites the waveform samples from the start location to the end location of the region of the memory, already read out via the readout controller, with a next partial long stream stored in the memory.

The loop readout operation of the memory rewrite controller is the same as that for the loop reproduction. Therefore, the readout controller for the loop reproduction can also be used for the long-stream reproduction, which thereby provides for an effective use of data-processing resources. For instance, the information indicative of the start and end locations for the long-stream reproduction may be input to the readout controller in place of loop start information and loop end information, in which case the readout controller performs loop readout on the region storing the partial long stream by repeating the advance of the address signal between the start and end locations indicated by the input information. By the memory rewrite controller sequentially rewriting the partial long stream in the region, different partial long streams can be sequentially read out through the loop readout process to reproduce a long stream of waveform samples. In this instance, the long stream of waveform samples is pre-stored in a suitable external (or internal) database, and the memory rewrite controller accesses the database to collectively retrieve any necessary partial long streams and then stores the retrieved necessary partial long streams into memory. In this case, the memory rewrite controller may retrieve the necessary partial long streams from the database with the assistance of an upper-order device (such as an upper-order computer). Because the necessary partial long streams can be retrieved collectively from the database under the control of the upper-order device, the retrieval of the long streams can be done without imposing substantial loads on the upper-order device.

To accomplish the object, the present invention also provides a waveform reproduction device which comprises:

a readable and writable memory that stores partial long-stream data constituting part of a long stream of compressed waveform samples based on a predetermined data compression scheme; a phase generator that generates, every sampling cycle, progressive phase information varying at a given reproduction rate, the readout controller repeating an advance of the phase information between a start location and an end location of a particular region of the memory which stores the partial long-stream data, to thereby perform loop readout of the region; a readout controller that sequentially reads out the compressed waveform samples from the memory on the basis of the phase information generated by the phase generator, the readout controller controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle; a compression decoder that decodes each of the compressed waveform samples read out from the memory, using a predetermined prediction value; a buffer that supplies the compression decoder with a previously decoded waveform sample as the predetermined prediction value, to thereby allow the compression decoder to decode all the compressed waveform samples read out from the memory; an output section that selects and outputs, from among the waveform samples decoded by the compression decoder, a decoded waveform sample corresponding to the phase information of the current sampling cycle; and a memory rewrite controller that, before an advance of the phase information returns from the end location to the start location, rewrites the waveform samples from the start location to the end location of the region of the memory, already read out via the readout controller, with a next partial long stream stored in the memory.

The invention arranged in the above-mentioned manner can implement both pitch reproduction and long stream reproduction using the aforementioned compressed waveform samples. Further, because a long stream of the compressed waveform samples can be reproduced, by use of a pitch-reproducing compression decoder or the like, without a need for a compression decoder dedicated to the long-stream reproduction, the inventive waveform reproduction device can be significantly simplified in structure and also made at low costs. In addition, the present invention can appropriately reproduce the long stream of compressed waveform samples by effectively using the readable and writable memory of a small capacity, which also contributes to the structural simplification and cost reduction of the waveform reproduction device.

The present invention may be implemented not only as a device invention as discussed above but also as a method invention. The present invention may also be practiced as a program for execution by a processor such as a computer or DSP, as well as a medium storing such a program.

BRIEF DESCRIPTION OF THE DRAWINGS

For better understanding of the object and other features of the present invention, its preferred embodiments will be described in greater detail herein-below with reference to the accompanying drawings, in which:

FIG. 13 is a table showing relationships between the second selection control information and selection signals generated via 15th and 18th selectors in accordance the second selection control information in the waveform reproduction device;

FIG. 14 is a table showing relationships between the second selection control information and latch signals generated via 12th and 14th latch circuits in accordance the second selection control information in the waveform reproduction device;

DETAILED DESCRIPTION OF THE PREFERRED EMBODIMENTS

Before going to a detailed description about the pitch shift reproduction, loop reproduction and long stream reproduction of compressed tone waveform samples in accordance with the present invention, an encoder and decoder typically used for the ADPCM (Adaptive Differential Pulse Code Modulation) coding scheme will first be described briefly with reference to FIGS. 1 and 2.

Figure 1:
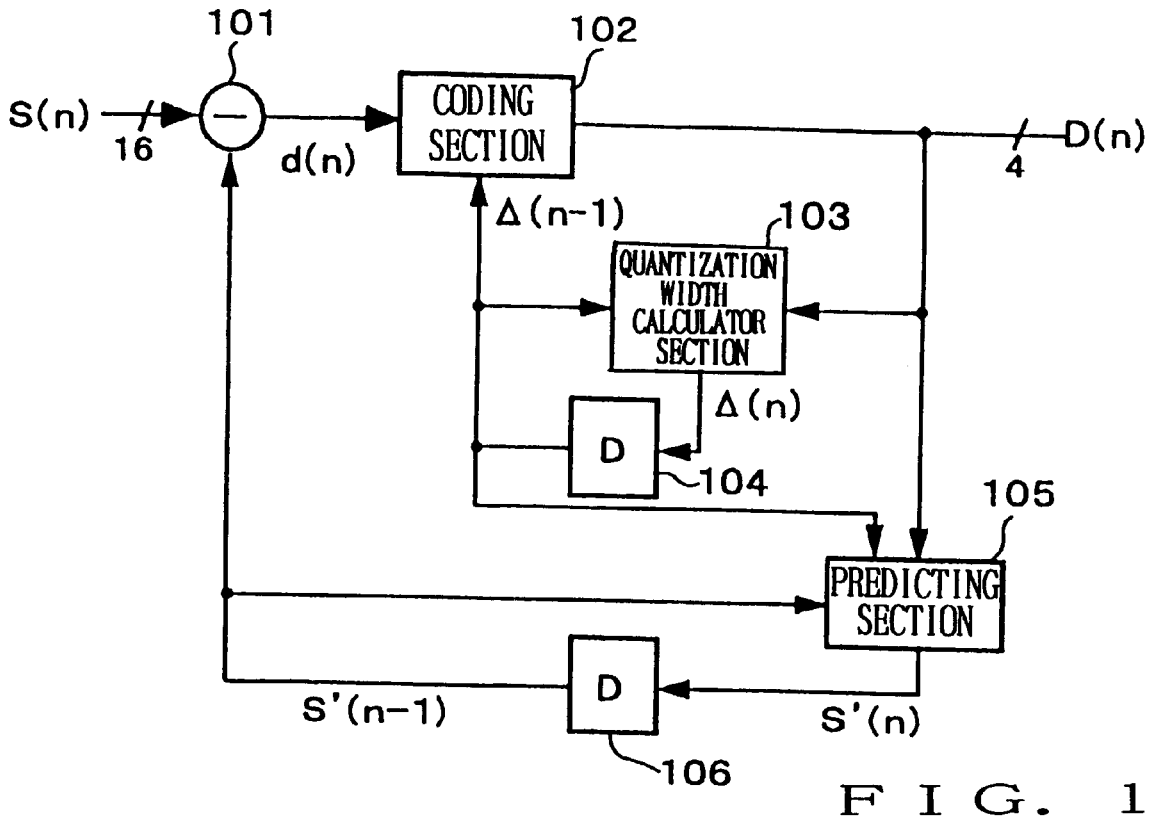
FIG. 1 is a block diagram showing a fundamental construction of an ADPCM encoder.

FIG. 1 is a block diagram showing a fundamental construction of the ADPCM encoder. In the illustrated ADPCM encoder, nth PCM data S(n), PCM-coded to represent a 16-bit tone waveform sample, is input to a subtracter 101 which calculates a difference between the input PCM data S(n) and prediction value data S'(n−1). Difference data d(n), indicative of the calculated difference, output from the subtracter 101 is given to a coding section 102, where it is quantized in accordance with a quantization width Δ(n−1) output from a quantization width calculator section 103 and then converted into a four-bit compressed tone waveform sample.

ADPCM data D(n), in the form of the four-bit compressed code, is output from the ADPCM encoder and also given to the quantization width calculator section 103 and a predicting section 105. The quantization width calculator section 103 performs a multiplication between the quantization width Δ(n−1) calculated last (most recently) by the section 103 and a function corresponding to a value of data within the ADPCM data D(n) excluding its sign bit, to thereby generate a new quantization width An. Namely, if the ADPCM data D(n) is expressed by a combination of L4(n), L3(n), L2(n) and L1(n) where L4(n) is the sign bit, the quantization width calculator section 103 carries out the following arithmetic operation:

$$\Delta n = f\{L3(n), L2(n), L1(n)\} * \Delta(n-1) \quad (1)$$

Signal representative of the quantization width Δn, generated by the quantization width calculator section 103, is delayed by a delay circuit 104 by one sampling time and then fed to the coding section 102 to be used for compression-coding a next input sample S(n+1).

The predicting section 105 performs an arithmetic operation among the ADPCM data D(n), quantization width Δ(n−1) calculated last by the quantization width calculator section 103 and prediction value data S'(n−1) calculated last by the section 105, to thereby compute a new prediction value S'(n). Equation for computing the new prediction value S'(n) is as follows:

$$S'(n) = \{1-2*L4(n)\}\ \{L3(n)+L2(n)/2+L1(n)/4+1/8\} * \Delta(n-1)+S'(n-1) \quad (2)$$

Signal representative of the prediction value S'(n) generated by the predicting section 105 is delayed by a delay circuit 106 by one sampling time and then fed to the coding section 102 to be used for compression-coding the next input sample S(n+1).

By the above-mentioned encoding operation, the 16-bit PCM sample is compressed into a four-bit ADPCM sample.

Figure 2:
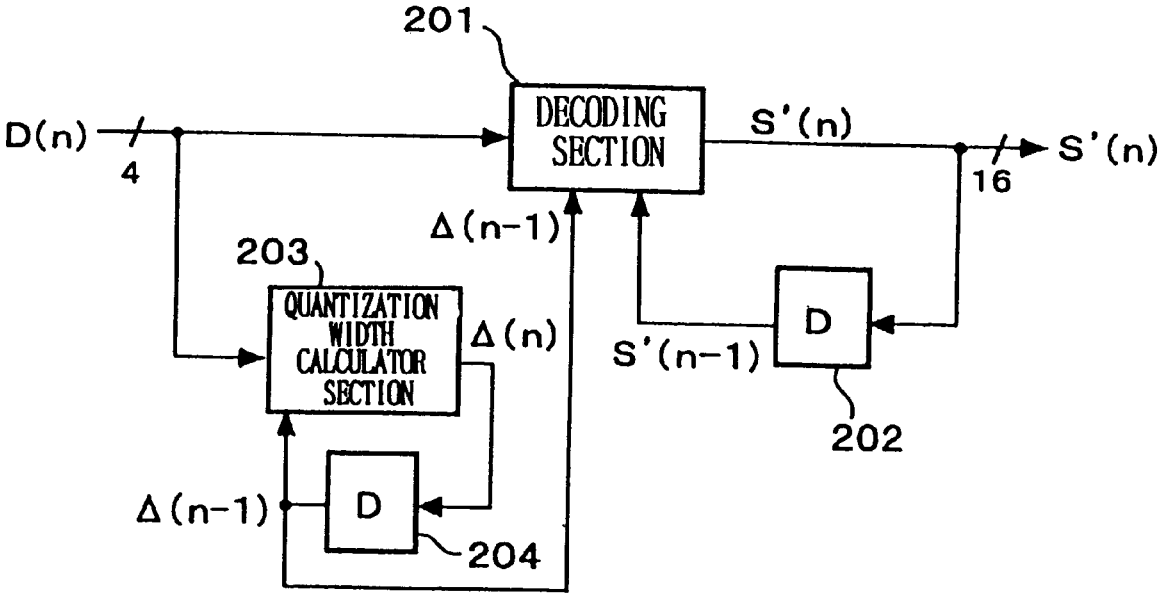
FIG. 2 is a block diagram illustrating a fundamental construction of an ADPCM decoder.

FIG. 2 is a block diagram illustrating a fundamental construction of the ADPCM decoder. In the illustrated ADPCM decoder, nth ADPCM data D(n), coded into the ADPCM format to represent a 4-bit sample, is input to a decoding section 201, where it is expanded or decompressed back to the original 16-bit PCM sample by being arithmetically operated with the quantization width Δ(n−1) and prediction value S'(n−1). The resultant decompressed 16-bit PCM sample is delayed by a delay circuit 202 by one sampling time and then fed to the decoding section 201 as prediction value data for use in expanding a next ADPCM sample D(n+1).

The input nth ADPCM sample D(n) is also applied to a quantization width calculator section 203. The quantization width calculator section 203 performs a multiplication between the quantization width Δ(n−1) calculated last (most recently) by the section 203 and a function corresponding to a value of data within the ADPCM data D(n) excluding its sign bit, to thereby generate a new quantization width An. Namely, the quantization width calculator section 203 too performs the arithmetic operation of Equation (1) above. The quantization width An generated by the quantization width calculator section 203 is delayed by a delay circuit 204 by one sampling time and then fed to the decoding section 201 as prediction value data for use in decompressing or expanding the next ADPCM sample D(n+1).

Through the above-mentioned decoding operation, the four-bit ADPCM sample is expanded or decompressed back to the original 16-bit PCM sample. Because there is a need, in the ADPCM decoder, to decode the ADPCM sample using the immediately preceding decoded sample as a prediction value, the original PCM sample can not be accurately reproduced unless the ADPCM samples are sequentially decoded one by one.

Figure 3:
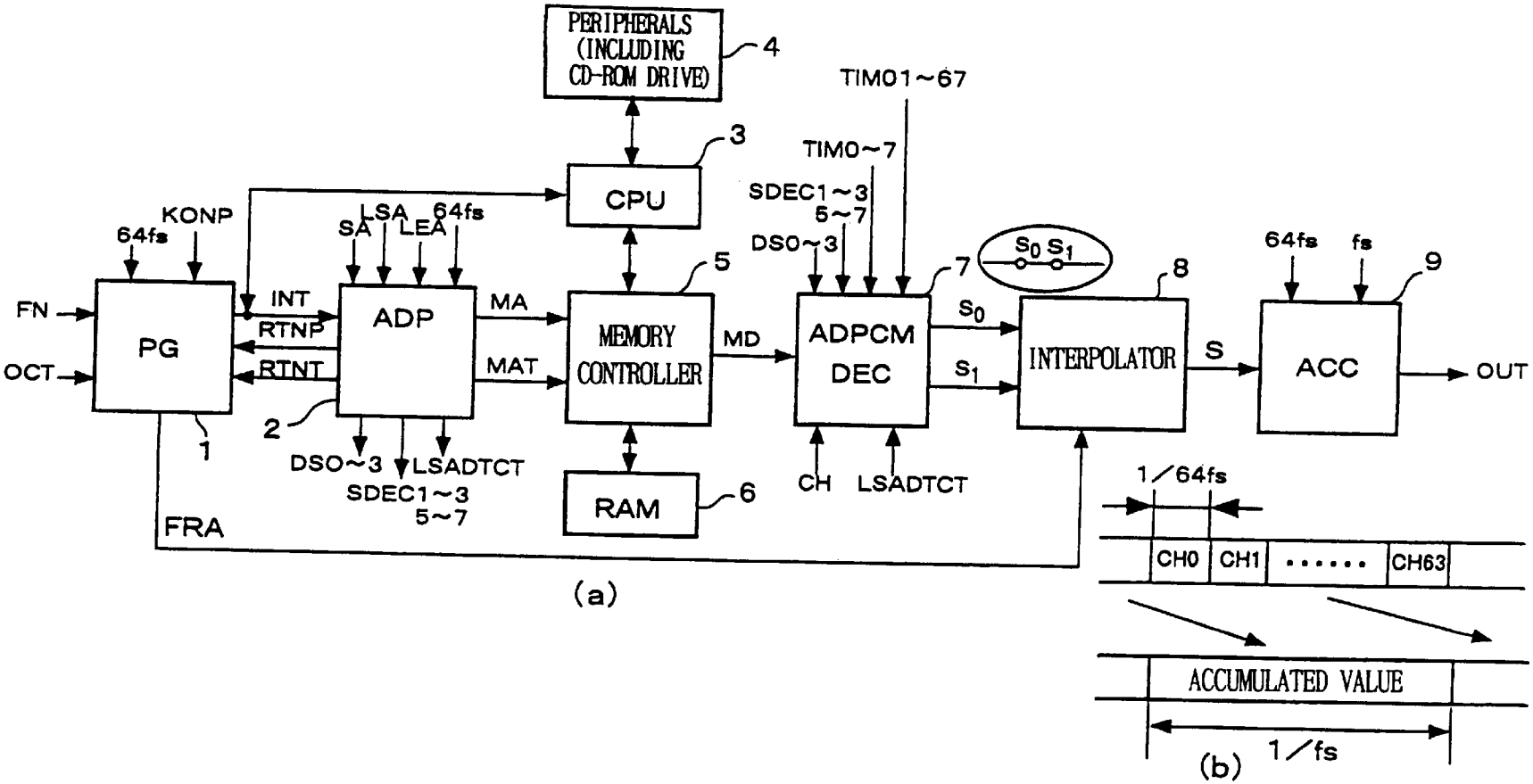
FIG. 3 is a block diagram showing an exemplary organization of a waveform reproduction device of the present invention using compressed tone waveform samples.

Fundamental construction of an ADPCM for use in the waveform reproduction device and method according to a preferred embodiment of the present invention is exactly the same as that of the decoder shown in FIG. 2, and part (a) of FIG. 3 shows, in a block diagram, a general organization of the inventive waveform reproduction device provided with the ADPCM decoder.

In part (a) of FIG. 3, reference numeral 1 denotes a phase generator (PG). The phase generator (PG) accumulates frequency information (FN), shifted in accordance with octave information (OCT), every predetermined sampling cycle based on a predetermined sampling frequency fs and outputs an integer portion INT and a decimal fraction portion of each accumulated value. However, the waveform reproduction device in accordance with the preferred embodiment, which handles or uses compressed tone waveform samples, is capable of simultaneously generating tones for 64 channels, so that the accumulation of the frequency information (FN), precisely speaking, is carried out for the channels in cycles 64 times the sampling frequency fs (i.e., 1/64 fs). Further, when a new key-on signal KONP is generated for any one of the 64 channels, the accumulated value for that channel is reset in response to the generation of the new key-on signal KONP.

Address pointer (ADP) 2 generates a memory address (MA) for accessing a RAM (Random Access Memory) 6 and memory access timing (MAT) information indicative of timing for accessing the RAM 6, to thereby control behavior of a memory controller 5. All tone waveform samples of a sustain tone, such as a brass or stringed instrument tone, covering from the start to end of the waveform can not be stored in a waveform memory due to its limited storage capacity, although all tone waveform samples of a tone of relatively short duration, such as a percussion instrument tone, covering from the start to end of the waveform can be stored in the memory. Therefore, for each sustain tone, the preferred embodiment employs the "loop reproduction" technique which reproduces the tone waveform samples in a loop fashion by repetitively reading out part of the tone waveform samples from the RAM 6.

For each musical instrument tone stored in the RAM 6, a "start address" SA represents an address of a memory space in which a first ADPCM tone waveform sample of the tone resides, and a "loop start address" LSA represents an address of a memory space in which a first ADPCM tone waveform sample of a reproduction loop resides. Further, a "loop end address" LEA represents an address of a memory space in which a last ADPCM tone waveform sample of the reproduction loop resides. Address pointer 2 generates the memory address MA to be accessed and memory access timing MAT on the basis of these addresses. Note that the start address is expressed in an absolute value while the loop start address LSA and loop end address LEA are expressed in relative values measured from the start address SA. Because one access to the RAM 6 can read out 16 bits from the RAM 6 and each ADPCM tone waveform sample consists of four bits in the preferred embodiment, a total of four ADPCM tone waveform samples can be read out from the RAM 6 at a time. Namely, each memory address in the RAM 6 corresponds to four ADPCM tone waveform samples.

CPU (Central Processing Unit) 3 shown in FIG. 3 functions as a higher-order device for controlling the waveform reproduction device of the present invention. Specifically, in response to a tone generation instruction, the CPU 3 operates to set various parameters in various components of the waveform reproduction device, reads out the ADPCM tone waveform samples via the memory controller 5 from a CD-ROM installed in a CD-ROM drive, one of peripheral devices 4, and transfers the read-out ADPCM tone waveform samples to the RAM 6 for storage therein. ADPCM decoder 7 sequentially decodes the read-out ADPCM tone waveform samples so that the samples are each expanded back to the original 16-bit PCM tone waveform sample. After that, two adjacent PCM tone waveform samples $S_0$ and $S_1$, necessary for obtaining an interpolated tone waveform sample corresponding to the decimal fraction data FRA of the phase information, are selected and output from the ADPCM decoder 7; namely, these two adjacent PCM tone waveform samples $S_0$ and $S_1$ are selected in accordance with selection control signals DS0–DS3, SDEC1–SDEC3 and SDEC5–SDEC7 generated by the address pointer 2 and are then output from the ADPCM decoder 7. The two PCM tone waveform samples $S_0$ and $S_1$ are fed to an interpolator 8, which, in turn, generates the interpolated sample corresponding to the decimal fraction data FRA and gives an accumulator ACC9 the interpolated sample as a tone waveform sample S.

The accumulator ACC9, as shown in part (b) of FIG. 3, accumulates the tone waveform samples of the 64 channels CH0–CH63, each supplied every 1/64 fs period, to thereby output the accumulated result to a digital-to-analog converter or DAC (not shown) every sampling cycle corresponding to the sampling frequency fs. Tone waveform signal converted by the DAC into analog representation is then audibly reproduced via a sound system as a tone signal.

In part (a) of FIG. 3, the peripherals devices 4 include the CD-ROM drive, from which the ADPCM tone waveform samples are read out during an initialization process of the waveform reproduction device and then stored into the RAM 6. In the case of long-stream reproduction, divided or partial long-stream data are sequentially read out from the CD-ROM to be stored in predetermined storage areas of the RAM 6.

Figure 4A:
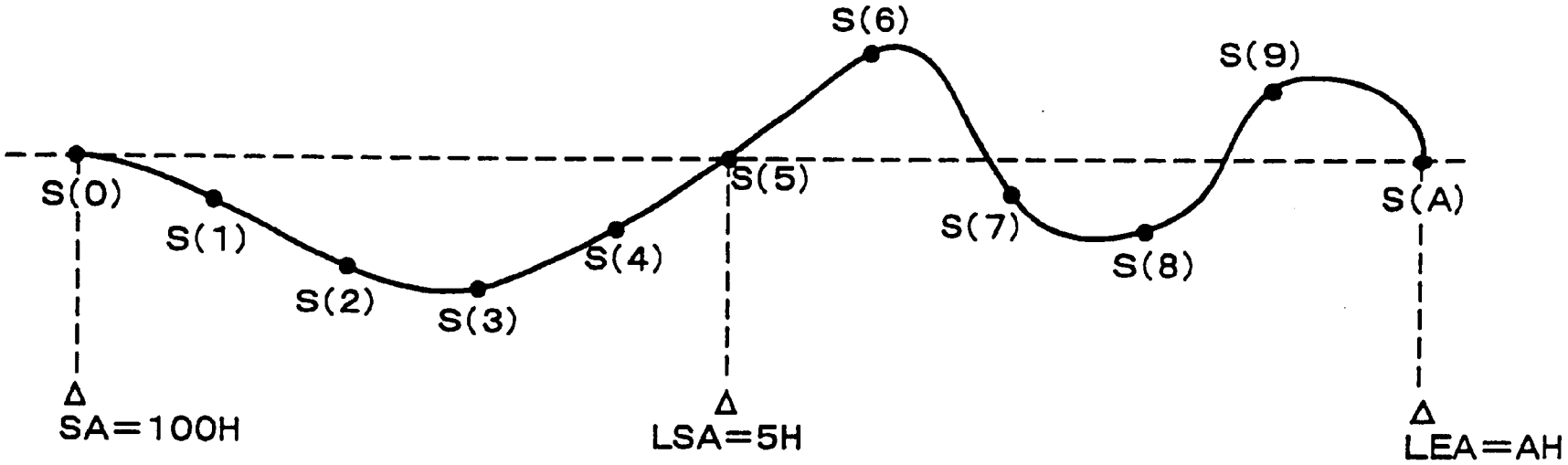
FIGS. 4A and 4B are diagrams explanatory of an exemplary manner in which tone waveform samples are compressed and then stored into memory in the waveform reproduction device of the present invention.
Figure 4B:
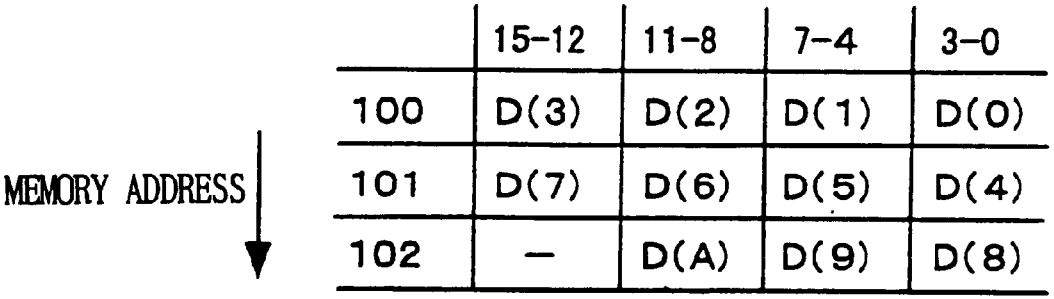

The following paragraphs describe the ADPCM tone waveform samples stored in the RAM 6, with reference to FIGS. 4A and 4B. FIG. 4A shows a tone waveform, where S(0), S(1), . . . , S(A) each represent a 16-bit PCM tone waveform sample obtained by sampling the tone waveform; note that each numerical value in parentheses is in hexadecimal notation. These PCM tone waveform samples S(0), S(1), . . . , S(A) are compression-coded, by the ADPCM encoder as shown FIG. 1, into four-bit ADPCM tone waveform samples D(0), D(1), . . . , D(A) and stored into the CD-ROM, from which they are then read out and stored into the RAM 6. For convenience of description, let's assume here that the ADPCM tone waveform samples D(0), D(1), . . . , D(A) are sequentially written into the RAM 6 starting at its address of 100.

Because the number of bits corresponding to one memory address is set to be 16 in the preferred embodiment, a total of four ADPCM tone waveform samples D(0), D(1), D(2) and D(3) are written into the memory address of 100, as shown in FIG. 4B. Similarly, the next four ADPCM tone waveform samples D(4), D(5), D(6) and D(7) are written into the next memory address of 101, and the remaining three ADPCM tone waveform samples D(8), D(9) and D(A) are written into the further next memory address of 102.

Thus, in the illustrated example, the start address SA of the PCM tone waveform samples S(0), S(1), . . . , S(A) is the address 100. Because it is preferable that the values of the loop start sample and loop end sample for the loop reproduction be substantially equal to each other, the loop start sample and loop end sample in the embodiment are set to, for example, S(5) and S(A), respectively. In this case, the loop start address LSA is expressed in a relative value of "5" from the start address SA, and similarly the loop end address LEA is expressed in a relative value of "A" from the start address SA. These address values are also in hexadecimal notation.

Figure 5A:
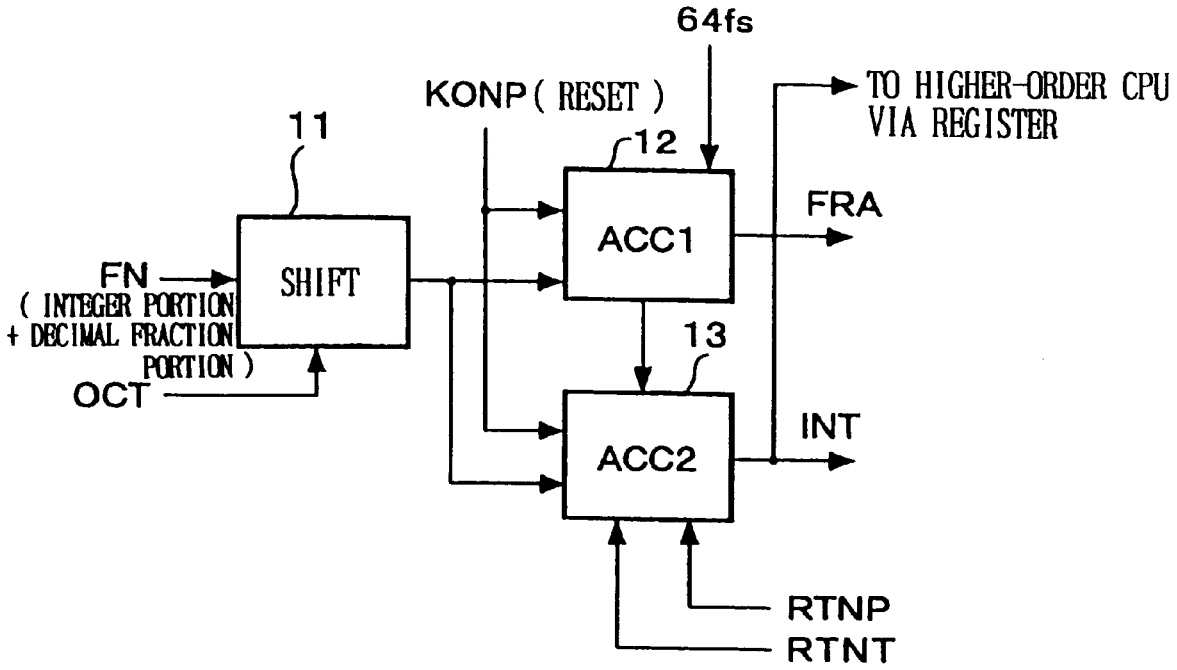
FIGS. 5A–5C are diagrams showing a structure and operation of a phase generator employed in the waveform reproduction device of the present invention.
Figure 5B:
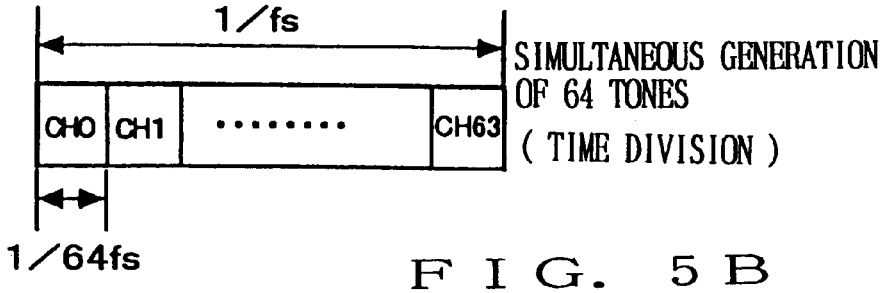

In FIG. 5A, there is shown an exemplary detailed construction of the phase generator PG1 employed in the embodiment. As shown, the frequency information FN expressed by the integer portion and decimal fraction portion is applied to a shifter 11, where it is shifted in accordance with octave information OCT given to the shifter 11 as a shift signal. As well known, each time the frequency information FN is shifted by one bit toward the most significant bit (MSB), its value increases by a factor of two, i.e., becomes two times greater. The frequency information FN, having been thus shifted by the shifter 11 in accordance with the octave information OCT, is fed to first and second accumulators (ACC1 and ACC2) 12 and 13, which accumulate the frequency information FN of each channel at the predetermined sampling frequency (i.e., 1/64 fs). The integer portion and decimal fraction portion of the thus-accumulated frequency information are output as integer portion data INT and decimal fraction portion data FRA, respectively. Whereas the sampling frequency is "fs" in the embodiment, the various components of the inventive waveform reproduction device, using the compressed tone waveform samples, are caused to operate time-divisionally at a time-divisional operating frequency of 64 fs to permit simultaneous tone generation for the 64 channels. Namely, the phase generator PG1, as shown in FIG. 5A, accumulates the frequency information of one of the channels CH0, CH1, . . . , CH63 every 1/64 fs period that is 1/64 of one sampling cycle (1/fs).

Whenever a new key-on signal KONP is generated for any one of the 64 channels, the accumulated value for that channel is reset in response to the generation of the new key-on signal KONP.

Figure 5C:
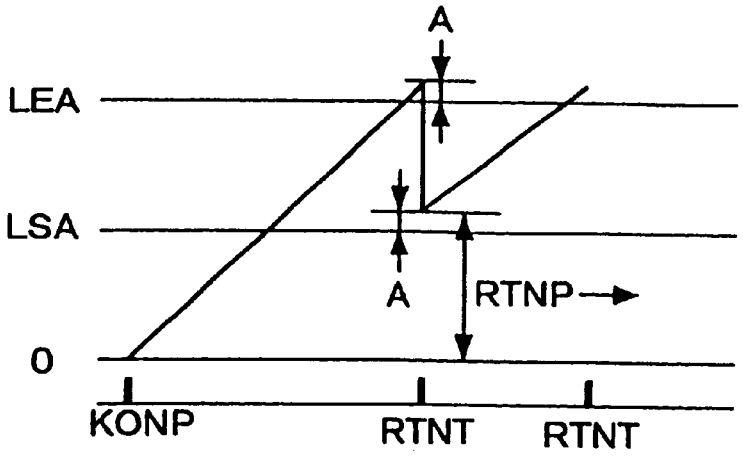

In FIG. 5C, there is shown a ramp waveform explanatory of how the accumulated value varies during the loop reproduction, where the horizontal axis represents passage of time while the vertical axis represents variations in the accumulated values output from the accumulators (ACC1 and ACC2) 12 and 13. Namely, as shown in FIG. 5C, the accumulated value for the channel in question is reset to a value of 0 at the time point when the key-on signal KONP is generated, so that the frequency information accumulation is restarted from the value 0 in such a way that the frequency information FN corresponding to the pitch of the tone designated by the key-on operation output from the shifter 11 is accumulated every 1/64 fs period. Thus, the accumulated value rises linearly rightward. Once it is detected that the accumulated value has exceeded the loop end address LEA, the accumulated value is returned to the loop start address LSA. To this end, a return timing signal RTNT, indicative of the time point when the accumulated value has exceeded the loop end address LEA, and a return value RTNP are fed to the accumulators (ACC1 and ACC2) 12 and 13. Here, the return value RTNP is obtained by adding an excessive value A to the loop start address LSA, and the accumulated value is reset to the value of "LSA+A" once the return timing signal RTNT is generated. These operations are repeated during the loop reproduction.

The integer portion data INT output from the second accumulator (ACC2) 13 is monitored by the CPU 3 to detect timing for sequentially reading out the divided or partial long-stream data from the CD-ROM in the peripheral CD-ROM drive 4 when the long stream is to be reproduced.

Figure 6:
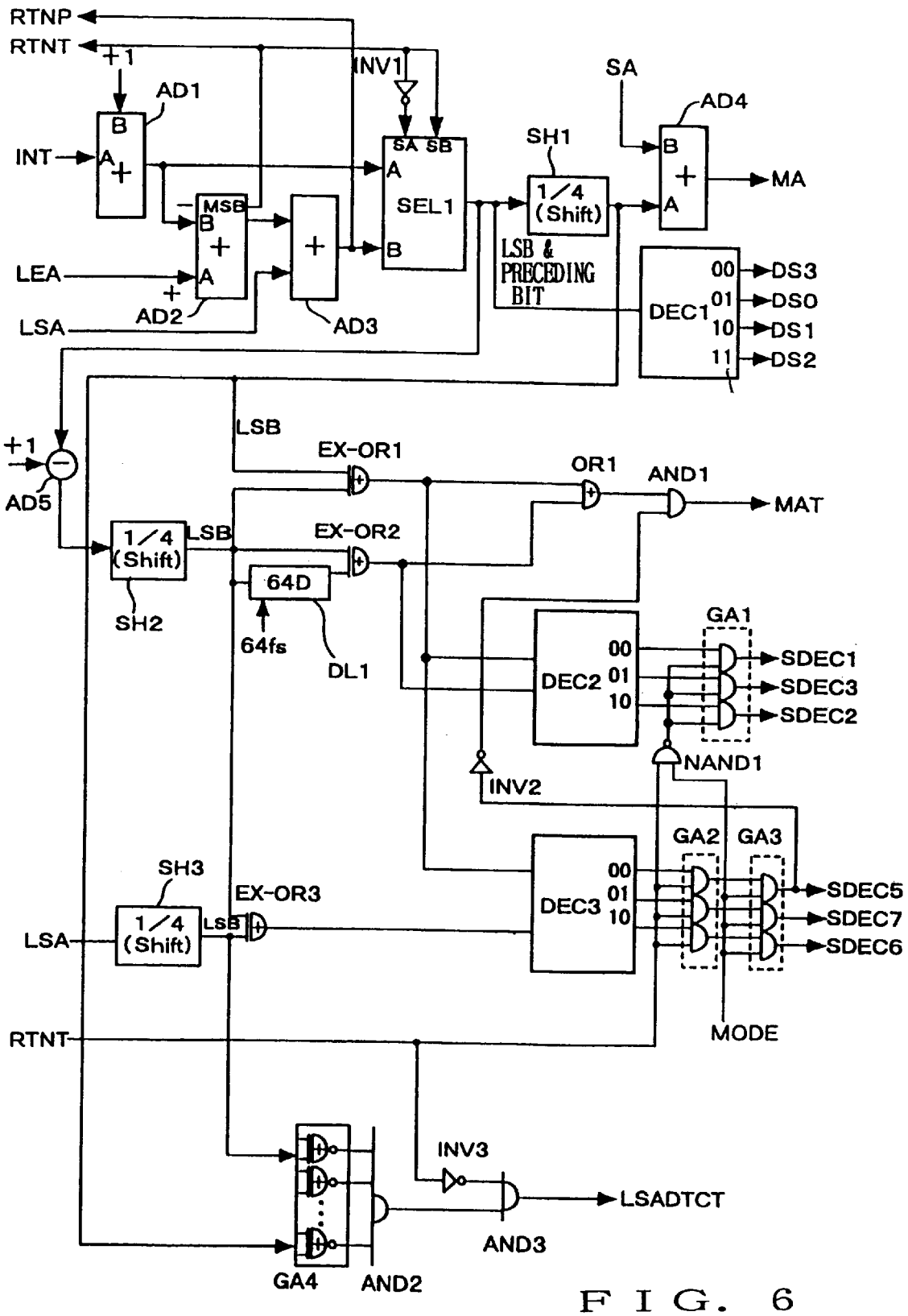
FIG. 6 is a block diagram showing an exemplary detailed organization of an address pointer employed in the waveform reproduction device of the present invention.

FIG. 6 is a block diagram showing an exemplary detailed organization of the address pointer (ADP) 2 employed in the preferred embodiment as shown in FIG. 3. The integer portion data INT of the accumulated value is given to a first adder AD1, where it is added with a value "+1" to provide integer portion data INT+1. This is for the purpose of interpolating, in accordance with the decimal fraction portion data FRA, between the sample represented by the integer portion data INT (i.e., sample corresponding to the current sampling cycle) and the sample represented by the data INT+1 in order to obtain a sample value corresponding to the accumulated value of the frequency information. The data INT+1 is passed to a first selector SELL and a second adder AD2. The second adder AD2 subtracts the data INT+1 from the loop end address LEA, and it is detected, from the level of the most significant bit (MSB) in the output from the adder AD2, whether or not the integer portion data INT+1 has exceeded the loop end address LEA. Namely, because the MSB, the sign bit, rises to a high level once the data INT+1 has exceeded the loop end address LEA, this signal is fed to the phase generator PG1 as the return timing signal RTNT. Further, the value obtained by subtracting the data INT+1 from the loop end address LEA is added with the loop start address LSA by a third adder AD3, and then the output from the third adder AD3 is passed to the phase generator PG1 as the return value RTNP.

The most significant bit (MSB) in the output from the second adder AD2 is supplied as a selection signal SB to select an input B of the first selector SEL1 and is also inverted by a first inverter INV1 to provide a selection signal SA to select an input A of the first selector SELL. This way, until the data INT+1 exceeds the loop end address LEA, the first selector SELL selects the input A to thereby output the data INT+1 given from the first adder AD1. But, once the integer portion data INT+1 exceeds the loop end address LEA, the first selector SEL1 selects the value obtained by subtracting the data INT+1 from the loop end address LEA and adding the resultant difference with the loop start address LSA. The output from the first selector SEL1 is shifted via a first shifter SH1 by two bits toward its least significant bit (LSB) to decrease in value by a factor of four, and the resultant least significant bit and the bit immediately preceding the same are fed to a first decoder DEC1. The reason why the output from the first selector SEL1 is shifted via the first shifter SH1 to decrease in value by the factor of 4 is that four ADPCM tone waveform samples are stored per address of the RAM 6. Then, the output from the first shifter SHI is added with the start address SA via a fourth adder AD4 to thereby generate a memory address MA for accessing the RAM 6.

The above-mentioned least significant bit and the bit immediately preceding the same are decoded by the first decoder DEC1 to generate first selection control information DS0–DS3. In this case, the first selection control information DS3 is generated when the two bits are "00", the selection control information DS0 is generated when the two bits are "01", and the selection control information DS2 is generated when the two bits are "11". As will be later described in detail, the first selection control information DS0–DS3 indicates which one of the four PCM tone waveform samples, having been decoded from the ADPCM format by being expanded after readout by one access to the RAM 6, is the one corresponding to the data INT+1. In accordance with the first selection control information DS0–DS3, PCM tone waveform sample data $S_1$ corresponding to the data INT+1 and PCM tone waveform sample data $S_0$ corresponding to the data "INT" are selected and passed to the interpolator 8.

Further, the output from the first selector SELL is applied to a fifth adder AD5 so that a value 1 is subtracted therefrom, and then applied to a second shifter SH2 to be decreased in value by a factor of four. Therefore, the output from the second shifter SH2 becomes a memory address corresponding to the integer portion data "INT". The least significant bits in the outputs from the first shifter SHI and second shifter SH2 are applied to a first exclusive OR gate EX-OR1 so as to detect whether or not the two least significant bits coincide with each other. More specifically, if the two least significant bits coincide with each other, a low-level output is produced from the exclusive OR gate EX-OR1 so that a first AND gate AND1 keeps producing a low-level output. If, however, the two least significant bits do not coincide with each other, the exclusive OR gate EX-OR1 produces a high-level output so that a high-level signal is applied to one of two input terminals of the first AND gate AND1 whose other input terminal is normally maintained at high level—the other input terminal is turned to low level only when the second selection control information SDEC5 is generated as will be later described—; thus, the first AND gate AND1 outputs a high-level memory access timing signal MAT. Namely, the first exclusive OR gate EX-OR1 produces the high-level output when the memory address corresponding to the integer portion data INT+1 has incremented by one from the memory address corresponding to the integer portion data INT, and it is in this situation when the AND gate AND1 outputs the high-level memory access timing signal MAT. Because the memory addresses corresponding to the integer portion data INT and INT+1 coincide with or differ from each other only by one, it is sufficient to compare their respective least significant bits alone.

The least significant bit in the output from the second shifter SH2 is delayed via a first delay element DL1 by a time corresponding to the 64 cycles at the time-divisional operating frequency 64 fs and is also applied to one of input terminals of a second exclusive OR gate EXOR2 whose other input terminal is given the output from the first delay element DL1. Thus, the second exclusive OR gate EX-OR2 detects whether or not the current memory address corresponding to the integer portion data INT for the channel in question has incremented from the last memory address. If the current memory address has incremented from the last memory address, the exclusive OR gate EX-OR2 produces a high-level output, so that the AND gate AND1 outputs the high-level memory access timing signal MAT. Note that in the arrangement of FIG. 3, which assumes an upward pitch shift (hereinafter also called a "pitch-up" or "pitch-up process") across two octaves or less, the memory addresses are never incremented by more than one per sampling cycle, so that the comparison is made only between the least significant bits. As mentioned above, the high-level memory access timing signal MAT is output from the AND gate AND1 only when there has occurred an increment in the memory address corresponding to the necessary ADPCM tone waveform samples; thus, when there has been no increment in the memory address, no access is made to the RAM so that the loads on the CPU 3 can be lessened significantly. Note that the ADPCM tone waveform samples, becoming necessary when there has been no increment in the memory address, have already been read out, decoded from the ADPCM format and stored in a preceding-block RAM contained in the ADPCM decoder 7, by the current cycle. As stated above, the memory access timing signal MAT is output in response to the output from the second exclusive OR gate EX-OR2; thus, in a situation where other samples are present between the compressed tone waveform sample corresponding to the phase information (integer portion INT) of the last sampling cycle and the compressed tone waveform sample corresponding to the phase information (integer portion INT) of the current sampling cycle, all the successive samples can be read out reliably irrespective of the to-be-reproduced pitch without the other samples being skipped at all.

The outputs from the first and second exclusive OR gates EX-OR1 and EX-OR2 are decoded by a second decoder DE2 to generate the second selection control information SDEC1, SDEC2 or SDEC3. In this instance, the selection control information SDEC1 is generated when the two outputs are "00", the selection control information SDEC3 is generated when the two outputs are "01" with the output from the second exclusive OR gate EX-OR2 is at high level, and the selection control information SDEC2 is generated when the two outputs are "10" with the output from the first exclusive OR gate EX-OR1 is at high level. Normally, only when the return timing signal RTNT is generated, a first gate array GA1 is closed to prevent the generation of the second selection control information SDEC1, SDEC2 or SDEC3. Namely, the second selection control information SDEC1, SDEC2 and SDEC3 becomes necessary at time points other than when the reproduction loop is to be returned.

The loop start address LSA applied to the address pointer 2 is sent to a third shifter SH3, where it is decreased in value by a factor of four. Thus, the third shifter SH3 outputs a memory address of samples corresponding to the loop start address LSA. The least significant bits in the outputs from the third shifter SH3 and second shifter SH2 are applied to a third exclusive OR gate EX-OR3, which produces a high-level output when both the least significant bits do not coincide with each other. Second gate array GA2 is caused to open only in response to generation of the return timing signal RTNT and a third gate array GA3 is normally open, the output from the third exclusive OR gate EX-OR3 becomes effective only when the return timing signal RTNT is generated. In this way, the third exclusive OR gate EX-OR3 produces the high-level output when the memory address corresponding to the integer portion data INT, output from the second shifter 2 at the time of a reproduction loop return, has exceeded the memory address of the sample corresponding to the loop start address LSA.

The outputs from the first and third exclusive OR gates EX-OR1 and EX-OR3 are decoded by a third decoder DE3 to generate the second selection control information SDEC5, SDEC6 or SDEC7. In this instance, the second selection control information SDEC5 is generated when the two outputs are "00", the selection control information SDEC7 is generated when the two outputs are "01" with the output from the third exclusive OR gate EX-OR3 is at high level, and the selection control information SDEC6 is generated when the two outputs are "10" with the output from the first exclusive OR gate EX-OR1 is at high level. Because the second gate array GA2 is caused to open only in response to generation of the return timing signal RTNT and the third gate array GA3 is normally only when the return timing signal RTNT is generated, these second selection control information SDEC5–SDEC7 only at the return timing RTNT. Namely, the second selection control information SDEC5–SDEC7 becomes necessary only at a time point when the reproduction loop is to be returned.

Further, the outputs from the first and third shifters SH1 and SH3 are checked, by a fourth gate array GA4 and the second AND gate AND2, for coincidence of all the bits contained therein. High-level signal is output when the memory address of the sample corresponding to the integer portion data INT+1 has coincided with the memory address of the sample corresponding to the loop start address LSA. This high-level signal is generated, as a return-start-address detection signal LSADTCT, by a third AND signal AND3 which is normally open except when the return timing signal RTNT is being generated. The thus-generated return-start-address detection signal LSADTCT is used when the four ADPCM tone waveform samples read out by the memory address of the sample corresponding to the loop start address is decoded and temporarily stored.

Next, a description will be made about the significance of the second selection control information SDEC1–SDEC3 and SDEC5–SDEC7, with reference to FIG. 7.

Figure 7:
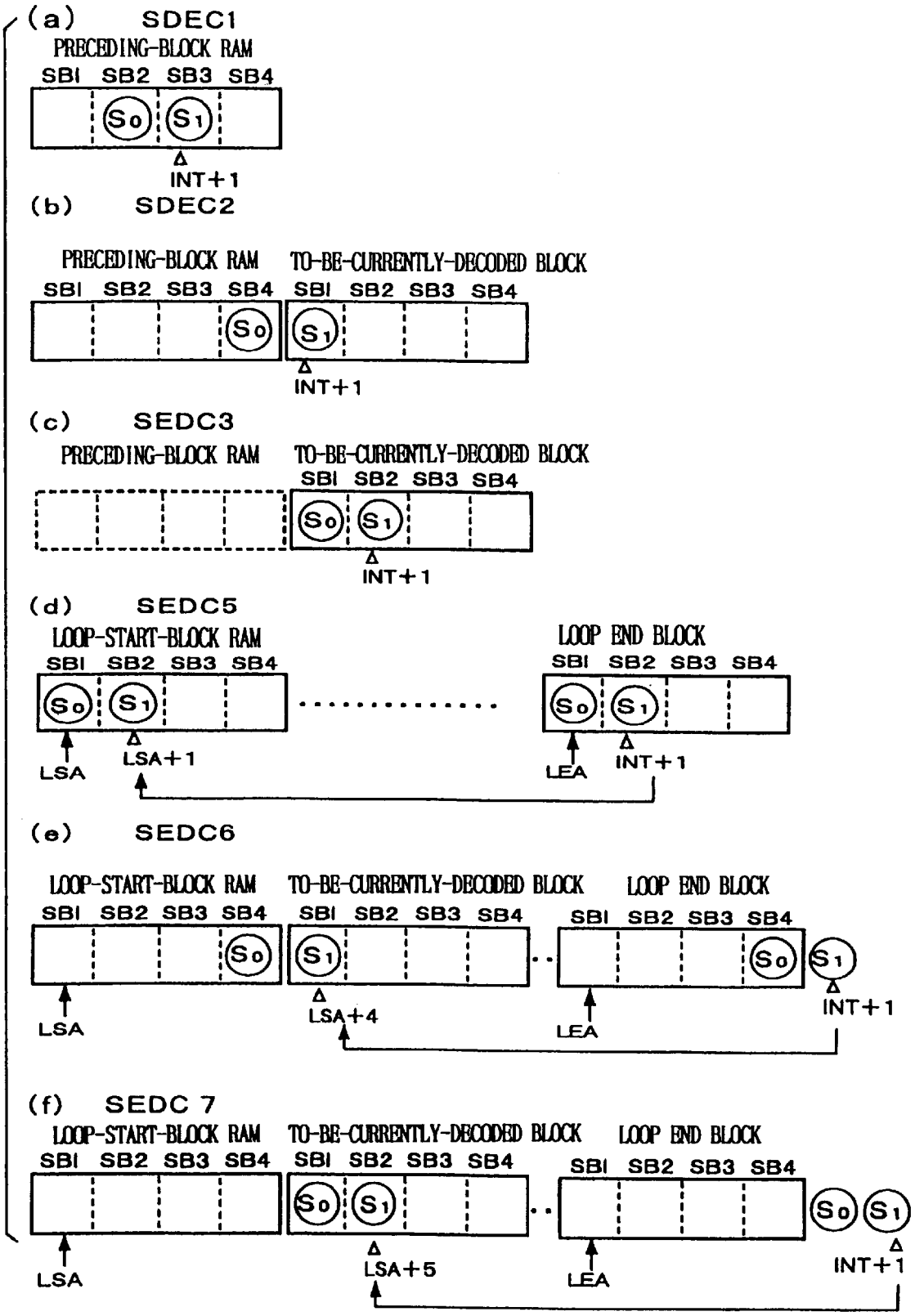
FIG. 7 is a diagram explanatory of behavior of the ADPCM decoder when second selection control information is generated in the waveform reproduction device of the present invention.

The second selection control information SDEC1 is generated in the preferred embodiment in a situation where the sample corresponding to the data INT+1 is already stored in the preceding-block RAM, as shown in part (a) of FIG. 7 where SO and Si both represent data stored in the preceding-block RAM. The preceding-block RAM is provided in the ADPCM decoder 7, where are stored four ADPCM tone waveform samples read out by a last access to the RAM 6 and then decoded by the ADPCM decoder 7. Hereinafter, the four ADPCM tone waveform samples and four PCM tone waveform samples obtained by decoding the same will be called a "block". Namely, in the preceding-block RAM, the most-recently-decoded four PCM tone waveform samples (each having been expanded to 16 bits) are stored at respective sub-blocks SB1–SB4. In this case, there is no need to access the RAM 6 because the sample corresponding to the data INT+1 is already stored in the preceding-block RAM. Therefore, when the selection control information SDEC1 is generated like this, the memory access timing signal MAT is not generated. Further, in the illustrated example, sample $S_1$ corresponding to the data INT+1 is stored at the third sub-block SB3 and sample $S_0$ corresponding to the integer portion data INT is stored at the second sub-block SB2.

The second selection control information SDEC2 is generated in a situation where the sample corresponding to the integer portion data INT+1 is made the sample at the leading or first sub-block SB1 of the to-be-currently-decoded block, as shown in part (b) of FIG. 7 where $S_0$ represents data stored in the preceding-block RAM and $S_1$ represents new data. Therefore, the sample at the first sub-block SB1 of the to-be-currently-decoded block is made sample $S_1$ and the sample at the last block SB4 of the adjoining preceding-block RAM is made sample $S_0$. In this case, there is a need to access the RAM 6 to obtain the to-be-currently-decoded block containing the sample corresponding to the data INT+1; thus, when the second selection control information SDEC2 is generated like this, the memory access timing signal MAT is generated.

The second selection control information SDEC3 is generated in a situation where the sample corresponding to the data INT+1 is made the sample at the sub-block following the second sub-block SB2 within the to-be-currently-decoded block, as shown in part (c) of FIG. 7 where $S_0$ and $S_1$ both represent new data. In the illustrated example, the sample at the second sub-block SB2 of the to-be-currently-decoded block is made sample $S_1$ and the sample at the adjoining first block SB1 of the to-becurrently-decoded block is made sample $S_0$. In this case, there is a need to access the RAM 6 to obtain the to-be-currently-decoded block containing the sample corresponding to the data INT+1; thus, when this second selection control information SDEC3 is generated like this, the memory access timing signal MAT is generated.

As briefly noted earlier, the second selection control information SDEC5 is generated when the reproduction loop is to be returned and in a situation where, as shown in part (d) of FIG. 7 (where $S_0$ and $S_1$ both represent data of the loop-start-block RAM), the sample corresponding to the integer portion data INT+1 is made the sample of the second sub-block SB2 and other sub-track in a loop end block containing the sample corresponding to the loop end address LEA and also the sample corresponding to the return value RTNP is a sample stored in the loop-start-block RAM. The loop-start-block RAM is provided in the ADPCM decoder 7, where are stored four PCM tone waveform samples decoded after being read out upon generation of the return-start-address detection signal LSADTCT. In the loop-start-block RAM, there is stored at least the sample corresponding to the loop start address LSA. In the illustrated example, the sample corresponding to the loop end address LEA is stored at the first sub-block SB1 of the loop end block, the sample corresponding to the data INT+1 is stored at the second sub-block SB2 of the loop end block, the sample corresponding to the loop start address LSA is stored at the first sub-block SB1 of the loop start block, and the sample corresponding to the data INT+1 at the loop return is stored at the second sub-block SB2 of the loop start block. In this case, there is no need to obtain the samples corresponding to the integer portion data INT and data INT+1 by accessing the RAM 6 and decoding the data read out from the RAM 6; therefore, when the selection control information SDEC5 is generated like this, the memory access timing signal MAT is generated.

The second selection control information SDEC6 is generated when the reproduction loop is to be returned and in a situation where, as shown in part (e) of FIG. 7 (where $S_0$ represents data of the loop-start-block RAM and $S_1$ represents new data), the sample corresponding to the data INT+1 is made a sample beyond the loop end block containing the sample corresponding to the loop end address LEA and also the sample corresponding to the return value RTNP is made a sample of the to-be-currently-decoded block following the block in the loop-start-block RAM. In the illustrated example, the sample corresponding to the loop end address LEA is stored at the first sub-block SB1 of the loop end block, the sample corresponding to the data INT+1 is made the sample beyond the loop end block, and the sample corresponding to the data INT+1 at the loop return is stored at the first sub-block of the to-be-currently-decoded block beyond the loop-start-block RAM. In this case, there is a need to obtain the to-be-currently-decoded block containing the sample corresponding to the data INT+1 by accessing the RAM 6 and decoding the data read out from the RAM 6; therefore, when the selection control information SDEC6 is generated like this, the memory access timing signal MAT is generated.

Similarly, the second selection control information SDEC7 is generated when the reproduction loop is to be returned and in a situation where, as shown in part (f) of FIG. 7 (where $S_0$ and $S_1$ both represent new data), the samples corresponding to the integer portion data INT and INT+1 are made samples beyond the loop end block containing the sample corresponding to the loop end address LEA and also the sample corresponding to the return value RTNP is made a sample of the to-be-currently-decoded block following the block stored in the loop-start-block RAM. In the illustrated example, the sample corresponding to the loop end address LEA is stored at the first sub-block SB1 of the loop end block, the samples corresponding to the integer portion data INT and INT+1 are made the samples beyond the loop end block, the sample corresponding to the loop start address LSA is stored at the first sub-block SB1 in the loop-start-block RAM, and the sample corresponding to the data INT and INT+1 at the loop return are stored at the first and second sub-blocks SB1 and SB2 of the to-be-currently-decoded block beyond the loop-start-block RAM. In this case, there is a need to obtain the to-be-currently-decoded block containing the sample corresponding to the data INT+1 by accessing the RAM 6 and decoding the data read out from the RAM 6; therefore, when the selection control information SDEC7 is generated like this, the memory access timing signal MAT is generated.

Figure 8:
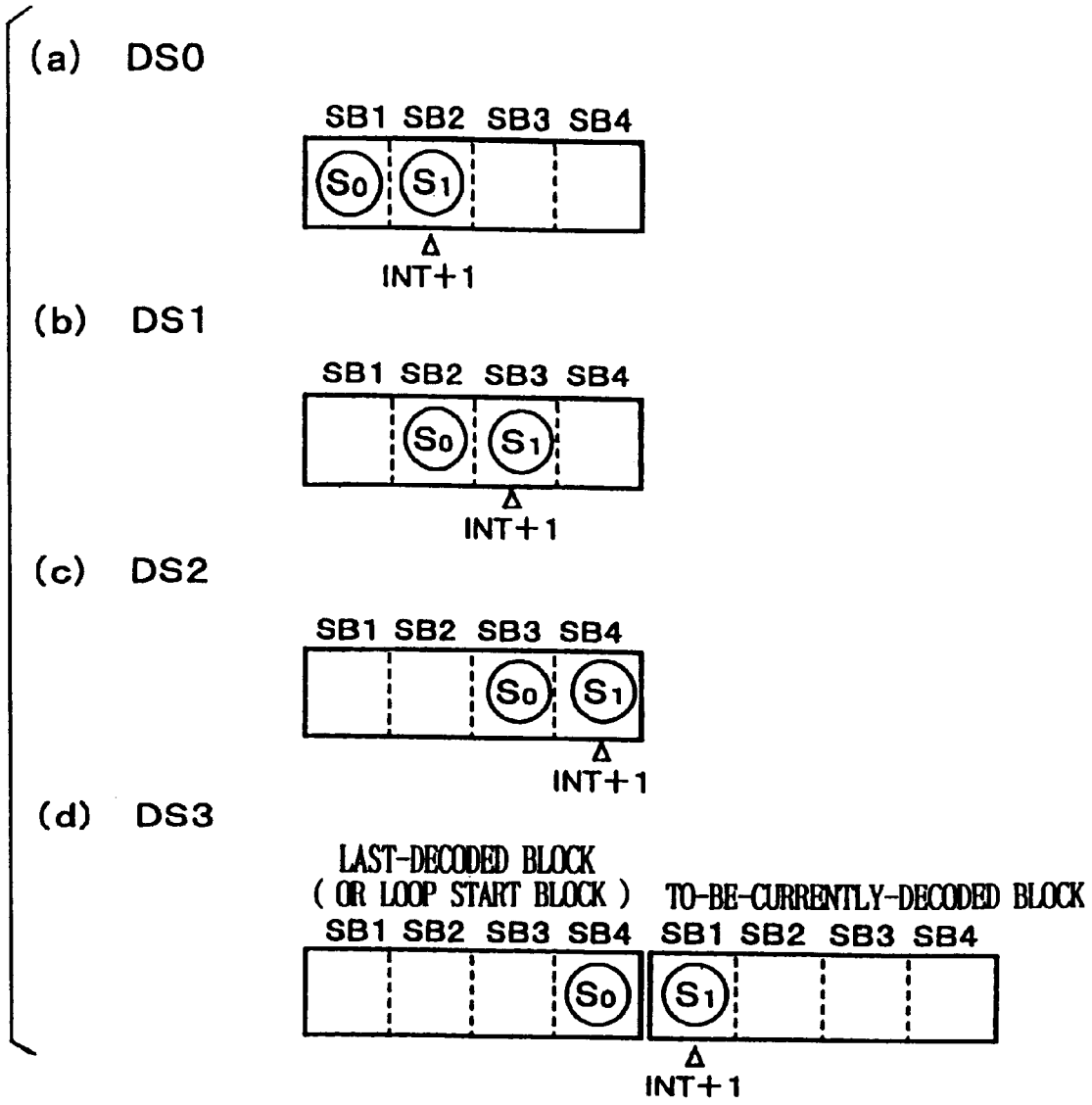
FIG. 8 is a diagram explanatory of behavior of the ADPCM decoder when first selection control information is generated in the waveform reproduction device of the present invention.

Next, a description will be made about the significance of the first selection control information DS0–DS3, with reference to FIG. 8. These first selection control information DS0–DS3 indicates at which of the sub-blocks in the preceding-block RAM and to-be-currently-decoded block the sample corresponding to the data INT+1 is located. When the first selection control information DS0 is generated, it is indicated that the sample corresponding to the integer portion data INT+1 is located at the second sub-block SB2 of the preceding-block RAM (or loop-start-block RAM). This first selection control information DS0 is generated along with any one of the above-mentioned second selection control information SDEC1, SDEC3, SDEC5 and SDEC7.

When the first selection control information DS1 is generated, it is indicated that the sample corresponding to the data INT+1 is located at the third sub-block SB3 of the preceding-block RAM (or loop-start-block RAM). This first selection control information DS1 is also generated along with any one of the second selection control information SDEC1, SDEC3, SDEC5 and SDEC7.

Further, when the first selection control information DS2 is generated, it is indicated that the sample corresponding to the data INT+1 is located at the fourth sub-block SB4 of the preceding-block RAM (or loop-start-block RAM). This first selection control information DS2 is also generated along with any one of the second selection control information SDEC1, SDEC3, SDEC5 and SDEC7. Note that the sample corresponding to the data INT in the case where any one of the first selection control information DS0–DS2 is made the sample at the immediately preceding sub-block in the same block.

Furthermore, when the first selection control information DS3 is generated, it is indicated that the sample corresponding to the data INT+1 is located at the first sub-block SB1 of the to-be-currently-decoded block. In this case, the sample corresponding to the data INT is located at the fourth sub-block SB4 of the preceding-block RAM (or loop-start-block RAM). This first selection control information DS3 is also generated along with any one of the second selection control information SDEC2 and SDEC6.

Figure 9:
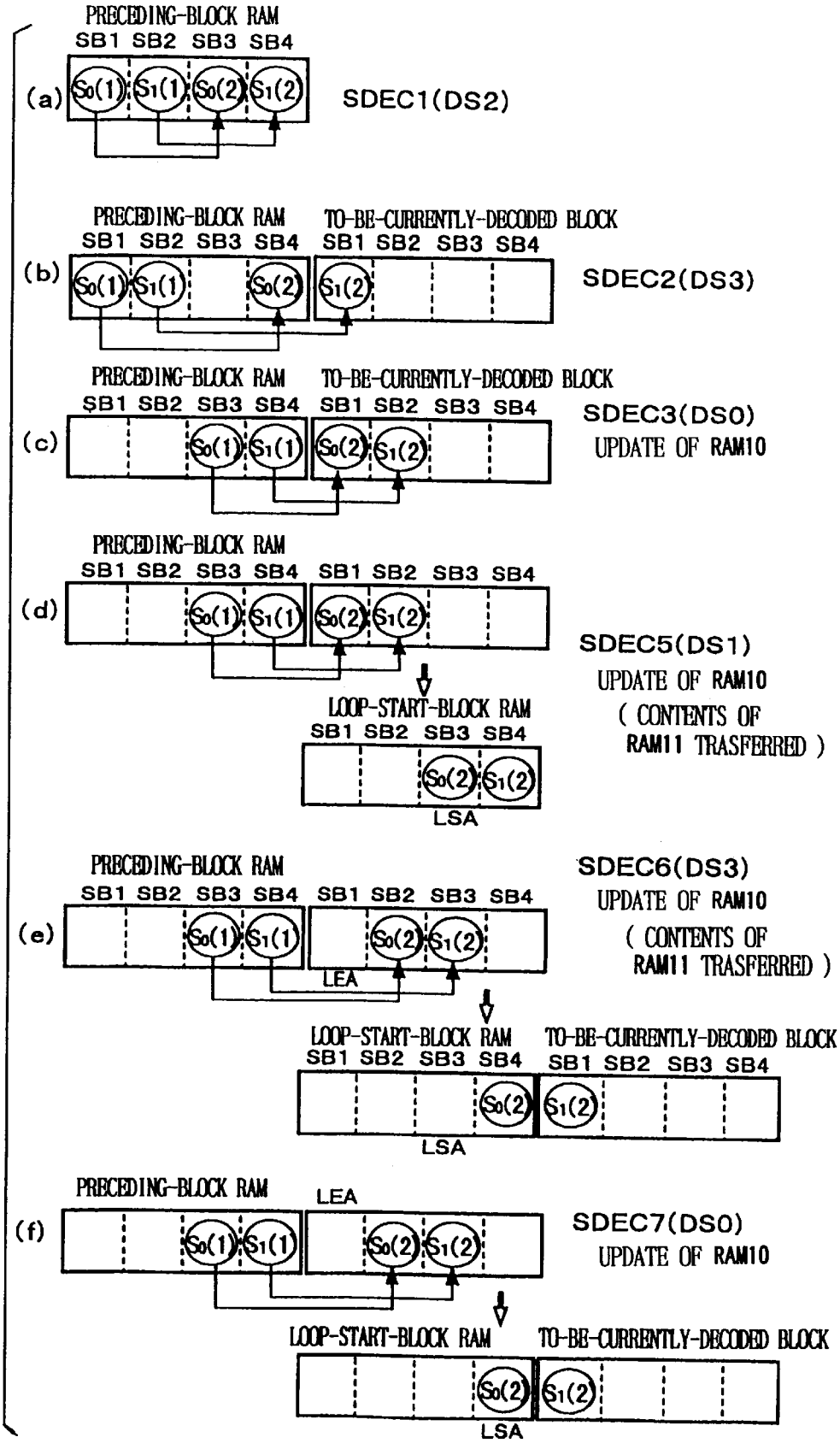
FIG. 9 is a diagram explanatory of behavior of the ADPCM decoder when first and second selection control information is simultaneously generated in the waveform reproduction device of the present invention.

Now, a description will be made about an exemplary detailed organization of the ADPCM decoder 7 shown in FIGS. 10 and 11, with additional reference to FIGS. 9, 12, 13 and 14. FIG. 9 shows how the preceding-block RAM and loop-start-block RAM are controlled during the decoding, FIG. 12 is a timing chart of the control, FIG. 13 shows relationships between the second selection control information and selection signals generated in accordance therewith, and FIG. 14 shows relationships between the first and selection control information and selection signals generated in accordance therewith. For convenience of illustration, the ADPCM decoder 7 is shown as divided across FIGS. 10 and 11, and same reference numerals L1–L11 in these two figures represent same lines.

Figure 10:
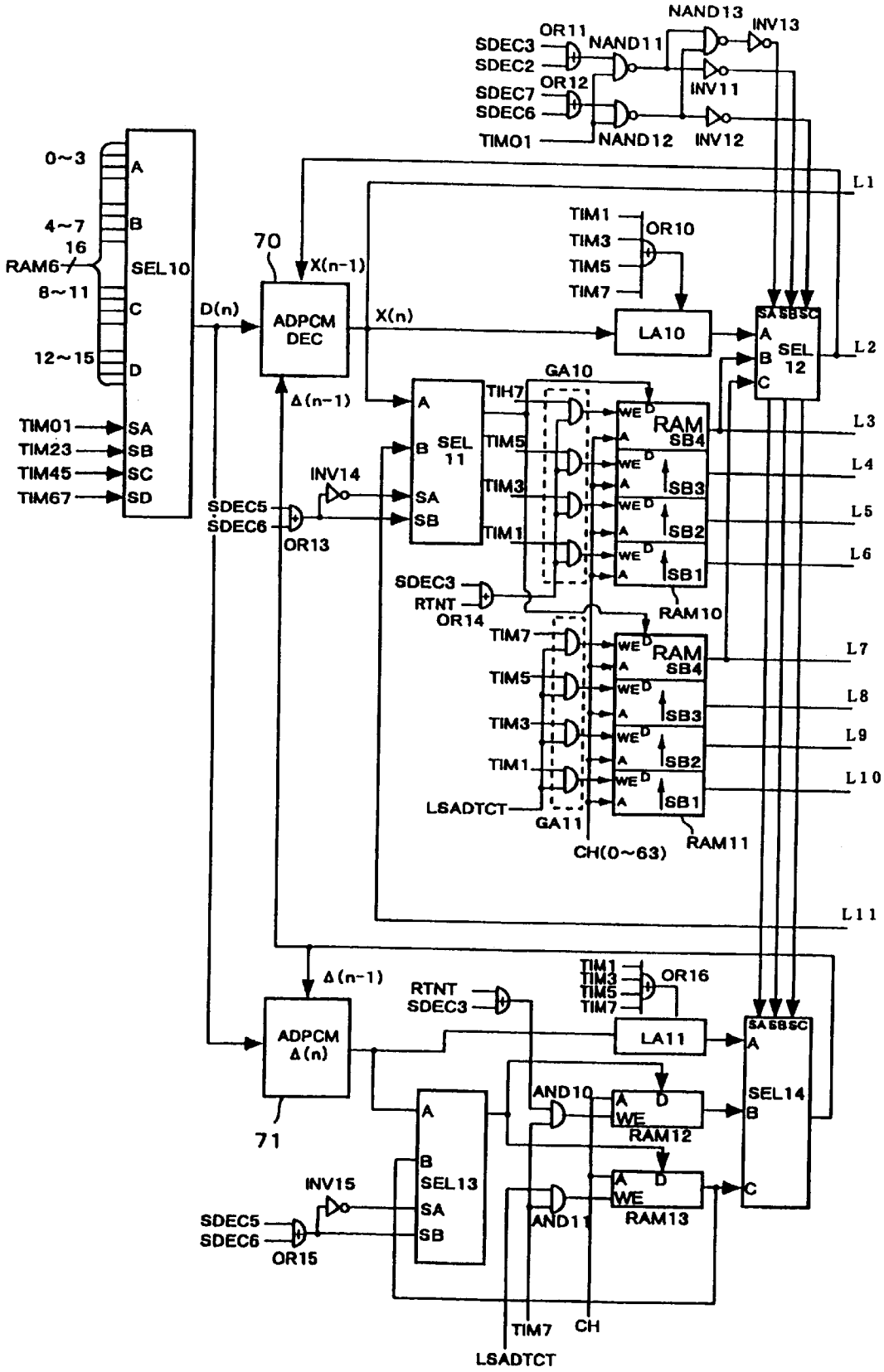
FIG. 10 is a block diagram showing an exemplary detailed organization of part of the ADPCM decoder employed in the waveform reproduction device of the present invention.
Figure 11:
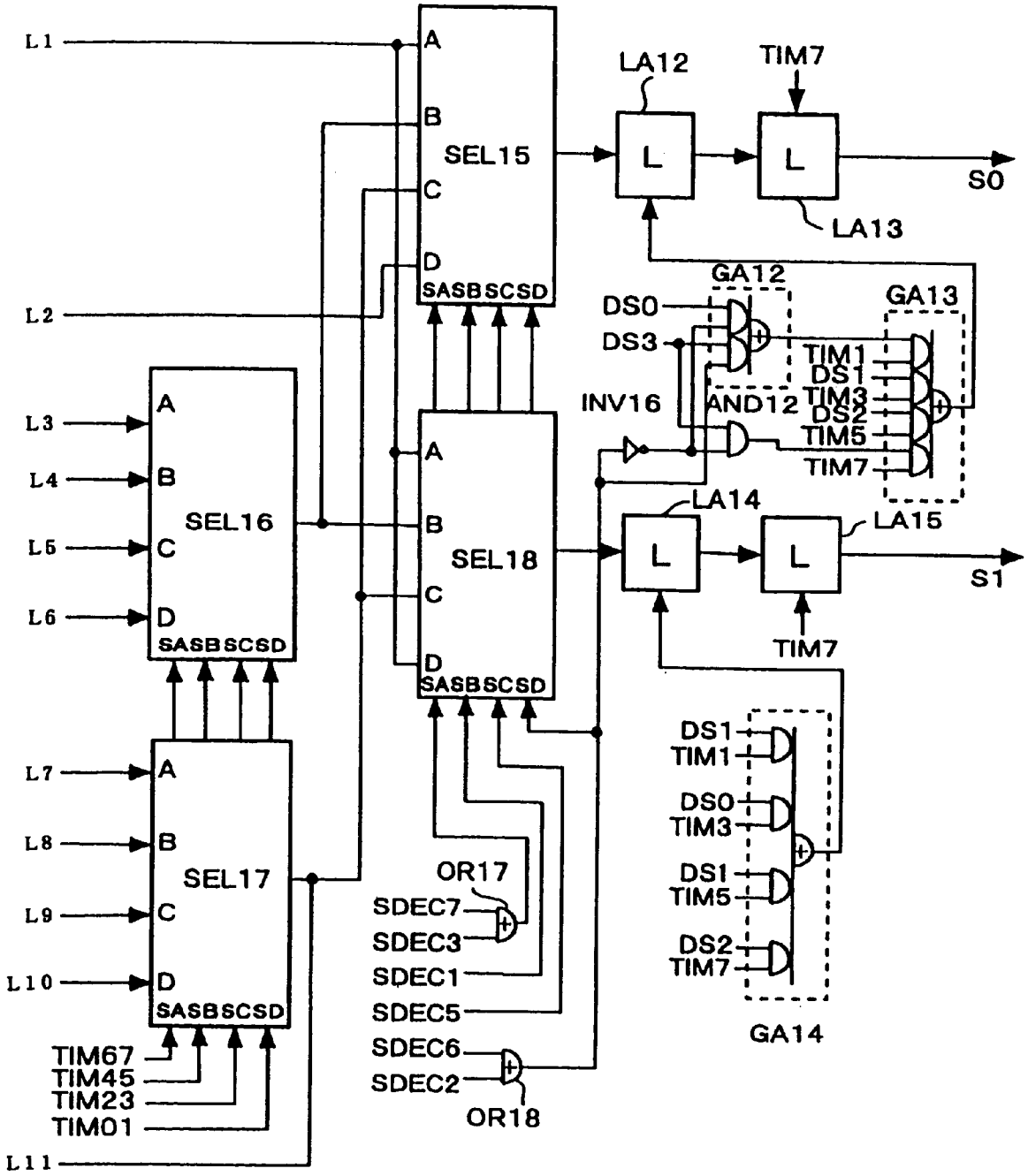
FIG. 11 is a block diagram showing the organization of a remaining part of the ADPCM decoder employed in the waveform reproduction device of the present invention.
Figure 12:
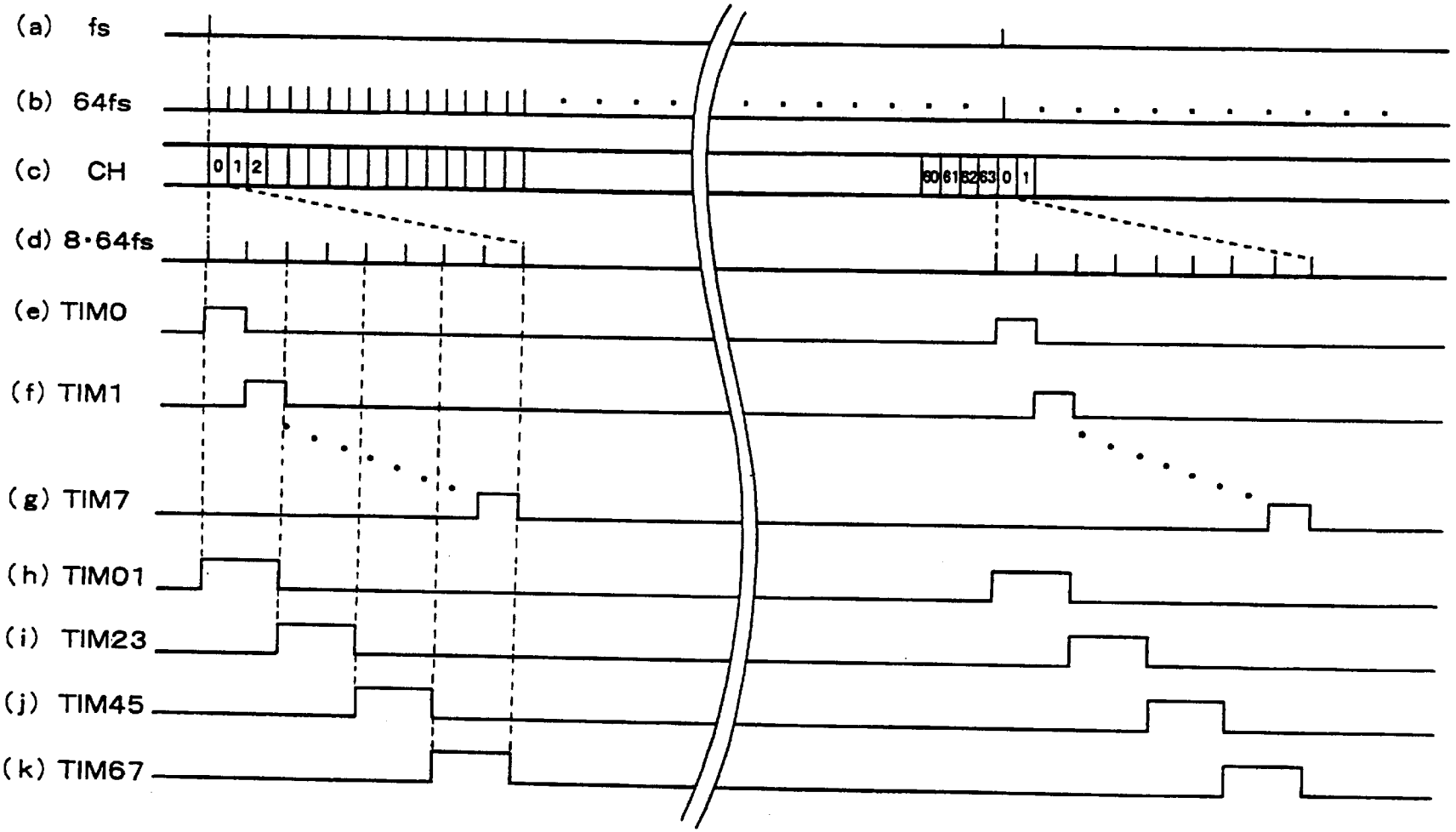
FIG. 12 is a timing chart explanatory of various control carried out in the waveform reproduction device of the present invention.

In the ADPCM decoder 7 shown in FIGS. 10 and 11, four ADPCM tone waveform samples, which are composed of a total of 16 bits and read out from the RAM 6, are introduced into four input terminals A, B, C and D, respectively, of a tenth selector SEL10 (i.e., four bits per input terminal) in a parallel fashion. To this tenth selector SEL10 are also applied a timing signal TIM01 shown in (h) of FIG. 12 as a selection signal SA to select the input A, a timing signal TIM23 shown in (i) of FIG. 12 as a selection signal SB to select the input B, a timing signal TIM45 shown in (j) of FIG. 12 as a selection signal SC to select the input C, and a timing signal TIM67 shown in (k) of FIG. 12 as a selection signal SD to select the input D.

Each of the timing signals TIM01–TIM67 has a pulse width equal to two periods (as shown in part (d) of FIG. 12) obtained by dividing, by eight, the 1/64 fs period shown in part (c) of FIG. 12 which is one period of the time-divisional processing sampling frequency 64 fs shown in part (b) of FIG. 12 and assigned to each channel (i.e., 1/64 fs*1/8). These timing signals TIM01–TIM67 are generated sequentially in such a manner that they do not overlap, as shown in parts (h)–(k) of FIG. 12. The four ADPCM tone waveform samples, introduced to the tenth selector SEL10 in parallel in response to the timing signals TIM01–TIM67, are sequentially selected in the order from input A to input D and then output one by one. The thus-output ADPCM tone waveform samples are then sequentially fed to an ADPCM decoder section 70, where they are decoded on the basis of the immediately preceding decoded sample X(n−1) used as the prediction value and the quantization width signal Δ(n−1). The PCM tone waveform samples X(n), expanded to 16 bits by the decoding, are latched in a tenth latch circuit LA10 at timing as dictated by timing signals TIM1, TIM3, TIM5 and TIM7, respectively, shown in parts (e)–(g) of FIG. 12 which are applied via a tenth OR gate OR10 to the latch circuit LA10. The timing signals TIM1, TIM3, TIM5 and TIM7 correspond to the respective latter halves of ON-periods of the timing signals TIM01–TIM67 and allow the PCM tone waveform samples to be latched in the latch circuit LA10 at respective predetermined timing after completion of the decoding by the ADPCM decoder section 70. Output from the latch circuit LA10 is passed to an input terminal A of a 12th selector SEL12.

The ADPCM tone waveform samples D(n) from the tenth selector SEL10 are also each applied to a quantization width calculator section 71, which evaluates Equation (1) above on the tone waveform sample D(n) in accordance with a quantization width Δ(n−1) selectively output from a 14th selector SEL14 to thereby generate a new quantization width Δ(n). The thus-generated quantization width Δ(n) is latched via a 16th OR gate OR16 in an 11th latch circuit LA11 at timing as dictated by the respective timing signal TIM1, TIM3, TIM5 or TIM7. The timing signals TIM1, TIM3, TIM5 and TIM7, as noted earlier, correspond to the respective latter halves of ON-periods of the timing signals TIM01–TIM67 and allow the quantization widths Δ(n) to be latched in the latch circuit LA11 at respective predetermined timing after completion of the calculation by the quantization width calculator section 71. Output from the 11th latch circuit LA11 is passed to an input terminal A of the 14th selector SEL14.

Explaining further the operation of decoding the ADPCM tone waveform samples, the A input is selected in the 12th selector SEL12 in accordance with a selection signal SA generated through operation of an 11th NAND gate NAND11, 12th NAND gate NAND12, 13th NAND gate NAND13 and 13th inverter INV13. Namely, the A input is selected at time points other than when the timing signal TIM01 is being generated. The sample X(n−1) selectively output from the 12th selector SEL12 is fed to the ADPCM decoder section 70 as the prediction value. Further, selection signals SA, SB and SC applied to the 14th selector SEL14 are the same as those applied to the 12th selector SEL12, and thus the A input is also selected in the 14th selector SEL14 at time points other than when the timing signal TIM01 is being generated. The selective output from the 14th selector SEL14 is fed to the ADPCM decoder section 70 as the quantization width signal Δ(n−1).

Assume here that the four ADPCM tone waveform samples fed to the tenth selector SEL10 are represented by D(0), D(1), D(2) and D(3), respectively. When the timing signal TIM23 is generated, the second ADPCM tone waveform sample D(1) at the B input selected in the tenth selector SEL10 is fed to the ADPCM decoder section 70. Simultaneously, a PCM tone waveform sample X(0), obtained by decoding the first ADPCM tone waveform sample D(0) via the ADPCM decoder section 70 and output from the tenth latch circuit LA10, is selectively output from the 12th selector SEL12 to the ADPCM decoder section 70 as the prediction value. Further, a quantization width Δ(0) calculated by the quantization width calculator section 71 and output from the 11th latch circuit LA11 is selectively output from the 14th selector SEL14 to the ADPCM decoder section 70. Thus, the ADPCM decoder section 70 can decode the ADPCM tone waveform sample D(1) using the immediately preceding decoded sample X(0) and quantization width Δ(0). Similar operations are performed when the timing signals TIM45 and TIM67 are generated, so that the four ADPCM tone waveform samples D(0), D(1), D(2) and D(3) can be decoded from the ADPCM format sequentially one by one. Operation of decoding the first read-out ADPCM tone waveform sample D(0) will be described in detail later.

Each of the PCM tone waveform samples X(n), obtained by the decoding via the ADPCM decoder section 70, is also applied to an input terminal A of the 11th selector SEL11. Selective output from a 17th selector SEL17 is passed to another input terminal B of the 11th selector SEL11. Selection signal SA to select the A input terminal of the 11th selector SEL11 is generated, through operation of a 13th OR gate OR13 and 14th inverter INV14, at time points other than when the second selection control information SDEC5, SDEC6 is being generated. Selection signal SB to select the B input terminal of the 11th selector SEL11 is generated through operation of the 13th OR gate OR13 at time points when the second selection control information SDEC5, SDEC6 is being generated. The second selection control information SDEC5, SDEC6 is generated in response to generation of the return timing signal RTNT, and thus, when the reproduction loop is not to be returned, the 11th selector SEL11 selectively outputs the PCM tone waveform sample X(n) applied to the A input terminal.

The selective output from the 11th selector SEL11 is given to the preceding-block RAM (RAM10) and loop-start-block RAM (RAM11) in a parallel fashion. The preceding-block RAM (RAM10) and loop-start-block RAM (RAM11) are each divided into the four sub-blocks SB1–SB4, each of which has a capacity to store samples for 64 channels. Write-enable signal WE to be applied to the first sub-block SB1 of the preceding-block RAM (RAM10) is generated, through operation of a tenth gate array GA10, at a time point TIM1 when the second selection control information SDEC3 or return timing signal RTNT is being generated. Write-enable signal WE to be applied to the second sub-block SB2 of the preceding-block RAM (RAM10) is generated at a time point TIM3 when the second selection control information SDEC3 or return timing signal RTNT is being generated. Write-enable signal WE to be applied to the third sub-block SB3 of the preceding-block RAM (RAM10) is generated at a time point TIM5 when the second selection control information SDEC3 or return timing signal RTNT is being generated. Further, a write-enable signal WE to be applied to the fourth sub-block SB4 of the preceding-block RAM (RAM10) is generated at a time point TIM7 when the second selection control information SDEC3 or return timing signal RTNT is being generated.

As shown in part (c) of FIG. 7, the second selection control information SDEC3 is generated when the sample corresponding to the data INT+1 becomes a sample of the second sub-block SB2 or other sub-block following the same in a block to be currently decoded. In response to generation of the second selection control information SDEC3, new access is made to the RAM 6 to read out a block of the ADPCM tone waveform samples. The read-out block of the ADPCM tone waveform samples are sequentially decoded as previously mentioned and then will be sequentially written into the preceding-block RAM RAM10 at generation timing of the above-mentioned write-enable signals WE. Channel selection signals CH0–CH63 are also applied to the preceding-block RAM RAM10 so that the decoded samples are written into RAM RAM10. When the RAM 6 is accessed in response to generation of the second selection control information SDEC3 like this, the stored contents of the preceding-block RAM RAM10 are renewed or updated with the ADPCM tone waveform samples read out from the RAM RAM10 and decoded into the PCM format.

Any one of the second selection control information SDEC5–SDEC7 is generated in response to the return timing signal RTNT. In the case where the second selection control information SDEC5 is generated, the sample corresponding to the data INT+1 becomes the sample of the second sub-block SB2 or other sub-block following the same in the loop-start-block RAM RAM11 as shown in part (d) of FIG. 7, so that there arises a need to transfer the stored contents of the loop-start-block RAM RAM11 to the preceding-block RAM RAM10 for renewal of the contents of the preceding-block RAM RAM10. Further, in the case where the second selection control information SDEC6 is generated, the sample corresponding to the integer portion data INT becomes the sample of the fourth sub-block in the loop-start-block RAM RAM11 as shown in part (e) of FIG. 7, so that, in this case too, there arises a need to transfer the stored contents of the loop-start-block RAM RAM11 to the preceding-block RAM RAM10 for renewal of the contents of the preceding-block RAM RAM10. Thus, the sample of the loop-start-block RAM RAM11, having been applied to the B input terminal of the 11th selector SEL11 is selectively output from the 11th selector SEL11, via the 17th selector SEL17, to the preceding-block RAM RAM10. In this manner, the stored contents of the preceding-block RAM RAM10 are renewed with those of the loop-start-block RAM RAM11.

Write-enable signal WE to be applied to the first sub-block SB1 of the loop-start-block RAM RAM11, to which the output from the 11th selector SEL11 is fed, is generated, through operation of an 11th gate array GA11, at the time point TIM1 when the loop-start-address detection signal LSADTCT is being generated. Write-enable signal WE to be applied to the second sub-block SB2 of the loop-start-block RAM RAM11 is generated, through operation of the 11th gate array GA11, at the time point TIM3 when the loop-start-address detection signal LSADTCT is being generated. Write-enable signal WE to be applied to the third sub-block SB3 of the loop-start-block RAM RAMl1 is generated, through operation of the 11th gate array GA11, at the time point TIM5 when the loop-start-address detection signal LSADTCT is being generated. Further, a write-enable signal WE to be applied to the fourth sub-block SB4 is generated, through operation of the 11th gate array GA11, at the time point TIM7 when the loop-start-address detection signal LSADTCT is being generated.

In the illustrated example, the loop-start-address detection signal LSADTCT is generated when the memory address of the sample corresponding to the data INT+1 has coincided with the memory address of the sample corresponding to the loop start address LSA, as noted earlier. This means that one block of the PCM tone waveform samples, obtained by reading out the ADPCM tone waveform samples through the new access to the RAM 6 during generation of the loop-start-address detection signal LSADTCT and decoding the read-out ADPCM tone waveform samples, contains the sample corresponding to the loop start address LSA. Therefore, by generating the write-enable signals WE to the loop-start-block RAM RAM11 at the above-mentioned respective timing, one block of the PCM tone waveform samples containing the sample corresponding to the loop start address LSA will be written into the loop-start-block RAM RAM1. Note that channel selection signals CH0–CH63 are also applied to the loop-start-block RAM RAM11 so that the decoded samples are written into the RAM RAM11 on a channel-by-channel basis. Thus, whenever the loop-start-address detection signal LSADTCT is generated, the PCM tone waveform samples, obtained by reading out the ADPCM tone waveform samples from the RAM 6 and decoding the read-out ADPCM tone waveform samples, are written into the loop-start-block RAM RAM11. The four samples output from the sub-blocks SB1–SB4 of the preceding-block RAM RAM10 are passed to input terminals A–D, respectively, of a 16th selector SEL16, while the four samples output from the sub-blocks SB1–SB4 of the loop-start-block RAM RAMl1 are passed to input terminals A–D, respectively, of a 17th selector SEL17. Further, the sample output from the first sub-block SB1 of the preceding-block RAM RAM10 is passed to the B input terminal of the 12th selector SEL12, and the sample output from the fourth sub-block SB4 of the loop-start-block RAM RAM11 is passed to the C input terminal of the 12th selector SEL12. The B input of the 12th selector SEL12 is selected by the selection signal SB generated in response to generation of the timing signal TIM01 when the second selection control information SDEC2 or SDEC3 has been generated. Namely, when the second selection control information SDEC2 or SDEC3 has been generated, as shown in parts (b) or (c) of FIG. 7, it is necessary to decode the ADPCM tone waveform samples read out by accessing the RAM 6. In this case, the sample, corresponding to the first sub-block SB1, in the to-be-currently-decoded block is decoded during a period represented by the timing TIM01; the decoding requires the immediately preceding decoded sample as the prediction value. The immediately preceding decoded sample has already been stored at the fourth sub-block SB4 of the preceding-block RAM RAM10, and thus this sample is selected by the 12th selector SEL12 and fed, as the sample of the prediction value X(n−1), to the ADPCM decoder section 70.

Further, the C input of the 12th selector SEL12 is selected by the selection signal SC generated in response to generation of the timing signal TIM01 when the second selection control information SDEC6 or SDEC7 has been generated. Namely, when the second selection control information SDEC6 or SDEC7 has been generated, as shown in parts (e) or (f) of FIG. 7, it is necessary to decode the ADPCM tone waveform samples read out by accessing the RAM 6 at the time of a reproduction loop return. In this case, the sample corresponding to the first sub-block SB1 in the to-be-currently-decoded block is decoded during the period represented by the timing TIM01; the decoding requires the immediately preceding decoded sample as the prediction value. Because the immediately preceding decoded sample has already been stored at the fourth sub-block SB4 of the loop-start-block RAM RAM1, this sample is selected by the 12th selector SEL12 and fed, as the sample of the prediction value X(n−1), to the ADPCM decoder section 70.

As further shown in FIG. 11, common selection signals SA, SB, SC and SD are applied to the 16th and 17th selectors SEL16 and SEL17 to which are fed the outputs of the preceding-block RAM RAM10 and loop-start-block RAM RAM11, respectively. In the illustrated example, the selection signal SA to select the A input corresponds to the timing signal TIM67, the selection signal SB to select the B input corresponds to the timing signal TIM45, the selection signal SC to select the C input corresponds to the timing signal TIM23, and the selection signal SD to select the D input corresponds to the timing signal TIM01.

In this way, the sample at the first sub-block SB1 of the preceding-block RAM RAM10 is selectively output from the 16th selector SEL16 in synchronism with generation of the timing signal TIM01, and the sample at the second sub-block SB2 of the preceding-block RAM RAM10 is selectively output from the 16th selector SEL16 in synchronism with generation of the timing signal TIM23. Further, the sample at the third sub-block SB3 of the preceding-block RAM RAM10 is selectively output from the 16th selector SEL16 in synchronism with generation of the timing signal TIM45, and the sample at the fourth sub-block SB4 of the preceding-block RAM RAM10 is selectively output from the 16th selector SEL16 in synchronism with generation of the timing signal TIM67. The output from the 16th selector SEL16 is passed to an input terminal B of a 15th selector SEL15 and an input terminal B of an 18 selector SEL18.

Further, the sample at the first sub-block SB1 of the loop-start-block RAM RAM11 is selectively output from the 17th selector SEL17 in synchronism with generation of the timing signal TIM01, and the sample at the second sub-block SB2 of the loop-start-block RAM RAM11 is selectively output from the 17th selector SEL17 in synchronism with generation of the timing signal TIM23. Further, the sample at the third sub-block SB3 of the loop-start-block RAM RAM11 is selectively output from the 17th selector SEL17 in synchronism with generation of the timing signal TIM45, and the sample at the fourth sub-block SB4 of the loop-start-block RAM RAM11 is selectively output from the 17th selector SEL17 in synchronism with generation of the timing signal TIM67. The output from the 17th selector SEL17 is passed to an input terminal C of the 15th selector SEL15 and an input terminal C of the 18 selector SEL18. The decoded output from the ADPCM decoder section 70 is passed directly to the A input terminal of the 15th selector SEL15 and the output from the 12th selector SEL12 is passed to an input terminal D of the 15th selector SEL15. In addition, the decoded output from the ADPCM decoder section 70 is passed directly to the other input terminals A and D of the 18th selector SEL18.

Common selection signals SA, SB, SC and SD are applied to the 15th and 18th selectors SEL15 and SEL18. Selection signal SA to select the A input is generated, through operation of a 17th OR gate OR17 when the second selection control information SDEC3 or SDEC7 has been generated, and a selection signal SB to select the B input is generated, through operation of the 17th OR gate OR17 when the second selection control information SDEC1 has been generated. Further, a selection signal SC to select the C input is generated, through operation of the 17th OR gate OR17 when the second selection control information SDEC5 has been generated, and a selection signal SD to select the D input is generated, through operation of an 18th OR gate OR18 when the second selection control information SDEC2 or SDEC6 has been generated.

The second selection control information SDEC1 is generated in the case where, as shown in part (a) of FIG. 9, the sample $S_0(1)$ last output from the 15th selector SEL15, sample $S_1(1)$ last output from the 18th selector SEL18, sample $S_0(2)$ to be currently output from the 15th selector SEL15 and sample $S_1(2)$ to be currently output from the 18th selector SEL18 have all been stored in the preceding-block RAM RAM10. Therefore, as shown in a row of "SDEC1" of FIG. 13, the selection signal SB is generated, and the B inputs of the 15th selector SEL15 and 18th selector SEL18, to which the output from the preceding-block RAM RAM10 is fed, are selected in such a way that the samples are output from the RAM RAM10 as the sample $S_1$ corresponding to the data INT+1 and the preceding sample $S_0$ corresponding to the data INT.

Further, the second selection control information SDEC2 is generated in the case where, as shown in part (b) of FIG. 9, the last-output samples $S_0(1)$ and $S_1(1)$ and sample $S_0(2)$ to be currently output from the 15th selector SEL15 have been stored in the preceding-block RAM RAM10 and the sample $S_1(2)$ to be currently output from the 18th selector SEL18 has been stored at the first sub-block SB1 of the to-be-currently-decoded block. Therefore, access is made to the RAM 6, and, as shown in a row of "SDEC2" of FIG. 13, the selection signal SD is generated and the D input of the 18th selector SEL18, to which the to-be-currently-decoded block from the ADPCM decoder section 70 is fed, is selected in such a way that the sample $S_1$ corresponding to the data INT+1 is selectively output from the to-be-currently-decoded block. Further, the selection signal SD is generated and the D input of the 15th selector SEL15, to which the output from the fourth sub-block SB4 of the preceding-block RAM RAM10 is fed via the 12th selector SEL12, is selected in such a way that the preceding sample $S_0$ corresponding to the data INT is read out from the fourth sub-block SB4 of the preceding-block RAM RAM10.

The second selection control information SDEC3 is generated in the case where, as shown in part (c) of FIG. 9, the last-output samples $S_0(1)$ and $S_1(1)$ have been stored in the preceding-block RAM RAM10, and the sample $S_0(2)$ to be currently output from the 15th selector SEL15 and sample $S_1(2)$ to be currently output from the 18th selector SEL18 are contained in the to-be-currently-decoded block. Therefore, access is made to the RAM 6, and, as shown in a row of "SDEC3" of FIG. 13, the selection signal SA is generated and the A inputs of the 15th and 18th selectors SEL15 and SEL18, to which the to-be-currently-decoded block from the ADPCM decoder section 70 is fed, are selected in such a way that the sample $S_1$ corresponding to the data INT+1 and preceding sample $S_0$ corresponding to the data INT are selectively output from the to-be-currently-decoded block.

Further, the second selection control information SDEC5 is generated in the case where the return timing signal RTNT signal has been generated, and, as shown in part (d) of FIG. 9, the last-output samples $S_0(1)$ and $S_1(1)$ have been stored in the preceding-block RAM RAM10, and the sample $S_0(2)$ to be currently output from the 15th selector SEL15 and sample $S_1(2)$ to be currently output from the 18th selector SEL18 have been stored in the loop-start-block RAM RAM1. Therefore, access is made to the RAM 6, and, as shown in a row of "SDEC5" of FIG. 13, the selection signal SC is generated and the C inputs of the 15th and 18th selectors SEL15 and SEL18, to which the output from the loop-start-block RAM RAM11 is fed via the 17th selector SEL17, are selected in such a way that the sample $S_1$ corresponding to the data INT+1 and preceding sample $S_0$ corresponding to the data INT are selectively output from the loop-start-block RAM RAM11.

The second selection control information SDEC6 is generated in the case where the return timing signal RTNT signal has been generated, and, as shown in part (e) of FIG. 9, the last-output samples $S_0(1)$ and sample $S_1(1)$ have been stored in the preceding-block RAM RAM10, the sample $S_0(2)$ to be currently output from the 15th selector SEL15 has been stored in the loop-start-block RAM RAM11 and also the sample $S_1(2)$ to be currently output from the 18th selector SEL18 is located at the first sub-block SB1 of the to-be-currently-decoded block. Therefore, access is made to the RAM 6, and, as shown in a row of "SDEC6" of FIG. 13, the selection signal SD is generated and the D input of the 18th selector SEL18, to which the to-be-currently-decoded block output from the ADPCM decoder section 70 is fed, is selected in such a way that the sample $S_1$ corresponding to the data INT+1 is selectively output from the to-be-currently-decoded block. In addition, the selection signal SD is generated and the D input of the 15th selector SEL15, to which the output from the fourth sub-block SB4 of the loop-start-block RAM RAM1 is fed via the 12th selector SEL12, is selected in such a way that the preceding sample $S_0$ corresponding to the data INT is selectively output from the fourth sub-block SB4 of the loop-start-block RAM RAM11.

Further, the second selection control information SDEC7 is generated in the case where, as shown in part (f) of FIG. 9, the last-output samples $S_0(1)$ and $S_1(1)$ have been stored in the preceding-block RAM RAM10, and the sample $S_0(2)$ to be currently output from the 15th selector SEL15 and sample $S_1(2)$ to be currently output from the 18th selector SEL18 are contained in the to-be-currently-decoded block. Therefore, access is made to the RAM 6, and, as shown in a row of "SDEC7" of FIG. 13, the selection signal SA is generated and the A inputs of the 15th and 18th selectors SEL15 and SEL18, to which the to-be-currently-decoded block from the ADPCM decoder section 70 is fed, are selected in such a way that the sample $S_1$ corresponding to the data INT+1 and preceding sample $S_0$ corresponding to the data INT are selectively output from the to-be-currently-decoded block.

Note that in the situation where the second selection control information SDEC5, SDEC6 is generated, the stored contents of the loop-start-block RAM RAM11 are transferred to the preceding-block RAM RAM10 for update of the contents of the RAM RAM10. In this way, the selective output from the 17th selector SEL17, to which is fed the output from the loop-start-block RAM RAM11, is passed to the B input of the 11th selector SEL11, and, when second selection control information SDEC5, SDEC6 has been generated, the 11th selector SEL11 selects the B input to thereby feed the sample from the loop-start-block RAM RAM11 to the preceding-block RAM RAM10.

As stated above, the 18th selector SEL18 selects and outputs the sample $S_1$ corresponding to the integer portion data INT+1 and the 15th selector SEL15 selects and outputs the preceding sample $S_1$ corresponding to the integer portion data INT. However, these selectors SEL15 and SEL18 output unnecessary samples at some time points. Thus, 12th and 14th latch circuits LA12 and LA14 are provided following the 15th and 18th selectors SEL15 and SEL18, respectively, so that only necessary samples are output.

Next, behavior of the 12th and 14th latch circuits LA12 and LA14 will be described in relation to various combinations of the first selection control information DS0–DS3 and second selection control information SDEC1–SDEC3, SDEC5–SDEC7, with reference to FIGS. 13, 14 and 15.

Figure 15:
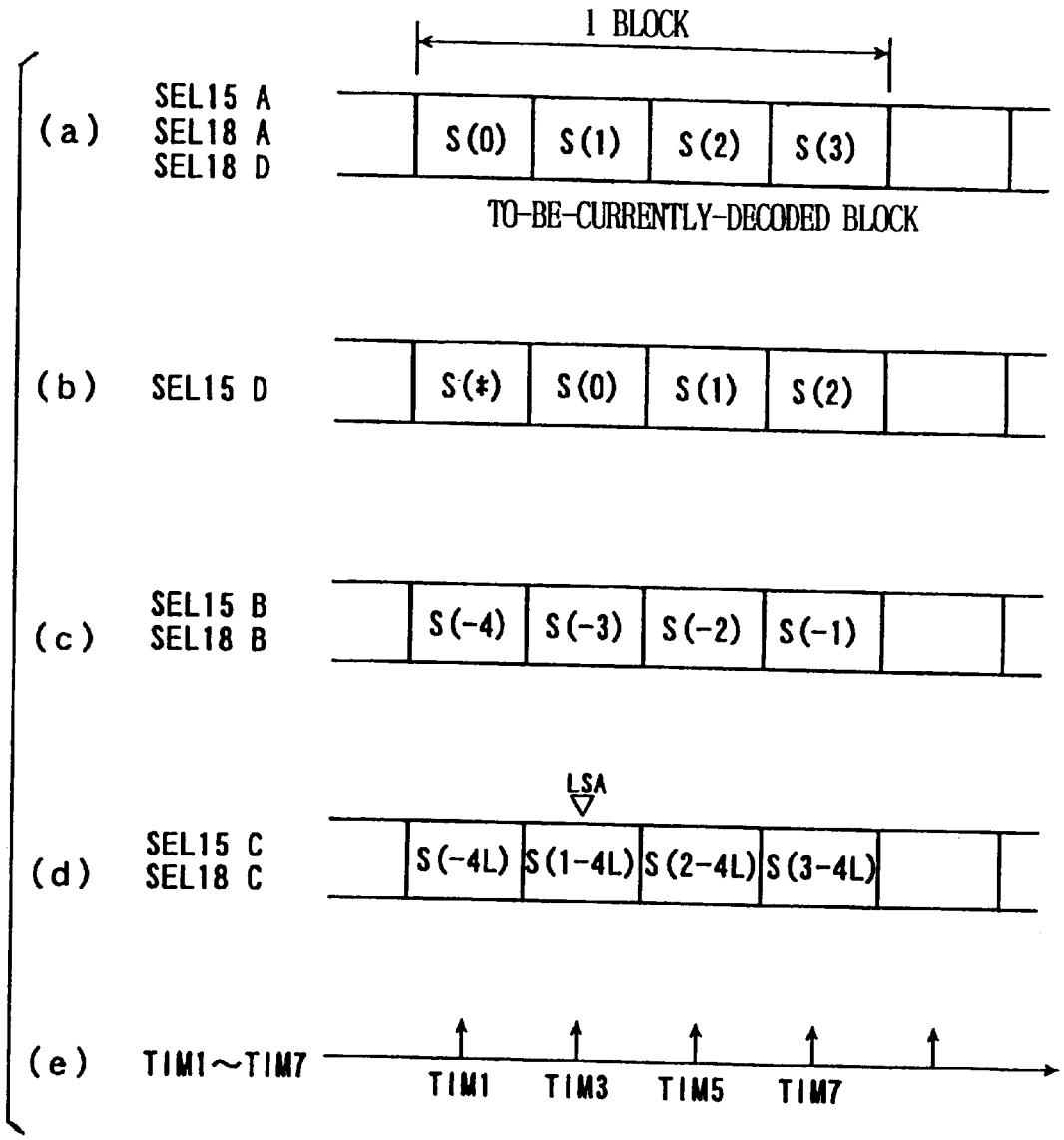
FIG. 15 is a diagram showing various tone waveform samples applied to input terminals A–D of the 15th and 18th selectors in the waveform reproduction device.

When the second selection control information SDEC1 and first selection control information DS0 has been generated simultaneously, the 15th and 18th selectors SEL15 and SEL18, at timing shown in part (e) of FIG. 15, each select and sequentially output the last decoded block, as shown in part (c) of FIG. 15, having been fed from the preceding-block RAM RIAM10 to the B input. In this case, as shown in a "<SDEC1>" section of FIG. 14, the timing signal TIM1 is applied, as a latch signal, to the 12th latch circuit LA12 through operation of a 16th inverter INV16, 12th gate array GA12 and 13th gate array, and the timing signal TIM3 is applied, as a latch signal, to the 14th latch circuit LA14 through operation of a 14th gate array GA14. Thus, a sample S(−4) at the first sub-block of the last decoded block is latched into the 12th latch circuit LA12, and a sample S(−3) is latched into the 14th latch circuit LA14. Namely, because the first selection control information DS0 has been generated this time, the sample at the first sub-block SB1 of the preceding-block RAM RAM10 is made the sample $S_0$ and the sample at the adjoining sub-block SB2 is made the sample $S_1$ as shown in part (a) of FIG. 8. The samples $S_0$ and $S_1$ thus latched in the 12th and 14th latch circuits LA12 and LA14 are output via 13th and 15th latch circuits LA13 and LA15 responsive to the timing signal TIM7, so as to be output in synchronism with each other.

When the second selection control information SDEC1 and first selection control information DS1 has been generated simultaneously, the 15th and 18th selectors SEL15 and SEL18, at the timing shown in part (e) of FIG. 15, each select and sequentially output the last decoded block as shown in part (c) of FIG. 15, similarly to the above-mentioned. In this case, as shown in the "<SDEC1>" section of FIG. 14, the timing signal TIM3 is applied, as a latch signal, to the 12th latch circuit LA12 through operation of the 13th gate array, and the timing signal TIM5 is applied, as a latch signal, to the 14th latch circuit LA14 through operation of the 14th gate array GA14. Thus, the sample S(−3) of the last decoded block is latched into the 12th latch circuit LA12, and a sample S(2) is latched into the 14th latch circuit LA14. Namely, because the first selection control information DS1 has been generated this time, the sample at the second sub-block SB2 of the preceding-block RAM RAM10 is made the sample $S_0$ and the sample at the adjoining sub-block SB3 is made the sample $S_1$ as shown in part (b) of FIG. 8. The samples $S_0$ and $S_1$ thus latched in the 12th and 14th latch circuits LA12 and LA14 are output via 13th and 15th latch circuits LA13 and LA15 responsive to the timing signal TIM7.

When the second selection control information SDEC1 and first selection control information DS2 has been generated simultaneously, the 15th and 18th selectors SEL15 and SEL18, at the timing shown in part (e) of FIG. 15, each select and sequentially output the last decoded block as shown in part (c) of FIG. 15, similarly to the above-mentioned. In this case, as shown in the "<SDEC1>" section of FIG. 14, the timing signal TIM5 is applied, as a latch signal, to the 12th latch circuit LA12 through operation of the 13th gate array, and the timing signal TIM7 is applied, as a latch signal, to the 14th latch circuit LA14 through operation of the 14th gate array GA14. Thus, the sample S(−2) of the last decoded block is latched into the 12th latch circuit LA12, and a sample S(−1) is latched into the 14th latch circuit LA14. Namely, because the first selection control information DS2 has been generated this time, the sample at the third sub-block SB3 of the preceding-block RAM RAM10 is made the sample $S_0$ and the sample at the adjoining sub-block SB4 is made the sample $S_1$ as shown in part (c) of FIG. 8 and part (a) of FIG. 9. The samples $S_0$ and $S_1$ thus latched in the 12th and 14th latch circuits LA12 and LA14 are output via 13th and 15th latch circuits LA13 and LA15 responsive to the timing signal TIM7.

The first selection control information DS3 is generated along with the second selection control information SDEC2, never with the second selection control information SDEC1. When the first selection control information DS3 has been generated along with the second selection control information SDEC2 like this, the 15th selector SEL15, at the timing shown in part (e) of FIG. 15, selects and sequentially outputs the to-be-currently-decoded block, shown in part (b) of FIG. 15, delayed by one sample and fed from the 12th selector SEL12 to its D input, and the 18th selector SEL18, at the timing shown in part (e) of FIG. 15, selects and sequentially outputs the to-be-currently-decoded block, shown in part (a) of FIG. 15, fed to its D input. In this case, as shown in a "<SDEC2>" section of FIG. 14, the timing signal TIM1 is applied, as a latch signal, to the 12th latch circuit LA12 through operation of the 18th OR gate OR18 and 13th gate array, and the timing signal TIM1 is applied, as a latch signal, to the 14th latch circuit LA14 through operation of the 14th gate array GA14. Thus, a sample S(0) of the to-be-currently-decoded block is latched into the 14th latch circuit LA14, and a sample S(*) immediately preceding the sample S(0) is latched into the 12th latch circuit LA12. Since the second selection control information SDEC2 is not generated at the time of a reproduction loop return, the sample S(*) becomes a last decoded sample. Namely, because the first selection control information DS3 has been generated this time, the sample at the first sub-block SB1 of the to-be-currently-decoded block is made the sample $S_1$ and the sample at the fourth sub-block SB4 of the immediately preceding decoded block (preceding-block RAM RAM10) is made the sample $S_0$ as shown in part (d) of FIG. 8 and part (b) of FIG. 9. The samples $S_0$ and $S_1$ thus latched in the 12th and 14th latch circuits LA12 and LA14 are output via 13th and 15th latch circuits LA13 and LA15 responsive to the timing signal TIM7, so as to be output in synchronism with each other.

When the second selection control information SDEC3 and first selection control information DS0 has been generated simultaneously, the 15th and 18th selectors SEL15 and SEL18, at the timing shown in part (e) of FIG. 15, each select and sequentially output the to-be-currently-decoded block, as shown in part (a) of FIG. 15, having been fed from the ADPCM decoder section 70 to the A input. In this case, as shown in a "<SDEC3>" section of FIG. 14, the timing signal TIM1 is applied, as a latch signal, to the 12th latch circuit LA12 through operation of the 16th inverter INV16, 12th gate array GA12 and 13th gate array, and the timing signal TIM3 is applied, as a latch signal, to the 14th latch circuit LA14 through operation of the 14th gate array GA14. Thus, the sample S(0) at the first sub-block SB1 of the to-be-currently-decoded block is latched into the 12th latch circuit LA12, and the adjoining sample S(1) is latched into the 14th latch circuit LA14. Namely, because the first selection control information DS0 has been generated this time, the sample at the first sub-block SB1 of the to-be-currently-decoded block is made the sample $S_0$ and the sample at the adjoining sub-block SB2 is made the sample $S_1$ as shown in part (a) of FIG. 8 and part (c) of FIG. 9. The samples $S_0$ and $S_1$ thus latched in the 12th and 14th latch circuits LA12 and LA14 are output via the 13th and 15th latch circuits LA13 and LA15 responsive to the timing signal TIM7, so as to be output in synchronism with each other.

When the second selection control information SDEC3 and first selection control information DS1 has been generated simultaneously, the 15th and 18th selectors SEL15 and SEL18, at the timing shown in part (e) of FIG. 15, each select and sequentially output the to-be-currently-decoded block, as shown in part (a) of FIG. 15, similarly to the above-mentioned. In this case, as shown in the "<SDEC3>" section of FIG. 14, the timing signal TIM3 is applied, as a latch signal, to the 12th latch circuit LA12 through operation of the 13th gate array GA13, and the timing signal TIM5 is applied, as a latch signal, to the 14th latch circuit LA14 through operation of the 14th gate array GA14. Thus, the sample S(1) of the to-be-currently-decoded block is latched into the 12th latch circuit LA12, and the adjoining sample S(2) is latched into the 14th latch circuit LA14. Namely, because the first selection control information DS1 has been generated this time, the sample at the second sub-block SB2 of the to-be-currently-decoded block is made the sample $S_0$ and the sample at the adjoining sub-block SB3 is made the sample $S_1$ as shown in part (b) of FIG. 8. The samples $S_0$ and $S_1$ thus latched in the 12th and 14th latch circuits LA12 and LA14 are output via the 13th and 15th latch circuits LA13 and LA15 responsive to the timing signal TIM7.

Further, when the second selection control information SDEC3 and first selection control information DS2 has been generated simultaneously, the 15th and 18th selectors SEL15 and SEL18, at the timing shown in part (e) of FIG. 15, each select and sequentially output the last-decoded block, as shown in part (a) of FIG. 15, similarly to the above-mentioned. In this case, as shown in the "<SDEC3>" section of FIG. 14, the timing signal TIM5 is applied, as a latch signal, to the 12th latch circuit LA12 through operation of the 13th gate array GA13, and the timing signal TIM7 is applied, as a latch signal, to the 14th latch circuit LA14 through operation of the 14th gate array GA14. Thus, the sample S(2) of the to-be-currently-decoded block is latched into the 12th latch circuit LA12, and a sample S(3) is latched into the 14th latch circuit LA14. Namely, because the first selection control information DS2 has been generated this time, the sample at the third sub-block SB3 of the to-be-currently-decoded block is made the sample $S_0$ and the sample at the adjoining sub-block SB4 is made the sample $S_1$ as shown in part (c) of FIG. 8. The samples $S_0$ and $S_1$ thus latched in the 12th and 14th latch circuits LA12 and LA14 are output via the 13th and 15th latch circuits LA13 and LA15 responsive to the timing signal TIM7.

When the second selection control information SDEC5 and first selection control information DS0 has been generated simultaneously, the 15th and 18th selectors SEL15 and SEL18, at the timing shown in part (e) of FIG. 15, each select and sequentially output the loop start block, as shown in part (d) of FIG. 15, having been fed from the loop-start-block RAM RAM11 to the C input. In this case, as shown in a "<SDEC5>" section of FIG. 14, the timing signal TIM1 is applied, as a latch signal, to the 12th latch circuit LA12 through operation of the 16th inverter INV16, 12th gate array GA12 and 13th gate array, and the timing signal TIM3 is applied, as a latch signal, to the 14th latch circuit LA14 through operation of the 14th gate array GA14. Thus, a sample S(−4L) at the first sub-block SB1 of the loop start block is latched into the 12th latch circuit LA12, and the adjoining sample S(1−4L) is latched into the 14th latch circuit LA14. Namely, because the first selection control information DS0 has been generated this time, the sample at the first sub-block SB1 of the loop start block is made the sample $S_0$ and the sample at the adjoining sub-block SB2 is made the sample $S_1$ as shown in part (a) of FIG. 8. The samples $S_0$ and $S_1$ thus latched in the 12th and 14th latch circuits LA12 and LA14 are output via the 13th and 15th latch circuits LA13 and LA15 responsive to the timing signal TIM7, so as to be output in synchronism with each other.

When the second selection control information SDEC5 and first selection control information DS1 has been generated simultaneously, the 15th and 18th selectors SEL15 and SEL18, at the timing shown in part (e) of FIG. 15, each select and sequentially output the to-be-currently-decoded block as shown in part (d) of FIG. 15, similarly to the above-mentioned. In this case, as shown in the "<SDEC5>" section of FIG. 14, the timing signal TIM3 is applied, as a latch signal, to the 12th latch circuit LA12 through operation of the 13th gate array GA13, and the timing signal TIM5 is applied, as a latch signal, to the 14th latch circuit LA14 through operation of the 14th gate array GA14. Thus, the sample S(1−4L) of the loop start block is latched into the 12th latch circuit LA12, and a sample S(2−4L) is latched into the 14th latch circuit LA14. Namely, because the first selection control information DS1 has been generated this time, the sample at the second sub-block SB2 of the loop-start-block RAM RAM11 is made the sample $S_0$ and the sample at the adjoining sub-block SB3 is made the sample $S_1$ as shown in part (b) of FIG. 8 and part (d) of FIG. 9. The samples $S_0$ and $S_1$ thus latched in the 12th and 14th latch circuits LA12 and LA14 are output via the 13th and 15th latch circuits LA13 and LA15 responsive to the timing signal TIM7.

Further, when the second selection control information SDEC5 and first selection control information DS2 has been generated simultaneously, the 15th and 18th selectors SEL15 and SEL18, at the timing shown in part (e) of FIG. 15, each select and sequentially output the loop start block as shown in part (d) of FIG. 15, similarly to the above-mentioned. In this case, as shown in the "<SDEC5>" section of FIG. 14, the timing signal TIM5 is applied, as a latch signal, to the 12th latch circuit LA12 through operation of the 13th gate array GA13, and the timing signal TIM7 is applied, as a latch signal, to the 14th latch circuit LA14 through operation of the 14th gate array GA14. Thus, the sample S(2−4L) of the loop start block is latched into the 12th latch circuit LA12, and a sample S(3−4L) is latched into the 14th latch circuit LA14. Namely, because the first selection control information DS2 has been generated this time, the sample at the third sub-block SB3 of the loop-start-block RAM RAM11 is made the sample $S_0$ and the sample at the adjoining sub-block SB4 is made the sample $S_1$ as shown in part (c) of FIG. 8. The samples $S_0$ and $S_1$ thus latched in the 12th and 14th latch circuits LA12 and LA14 are output via the 13th and 15th latch circuits LA13 and LA15 responsive to the timing signal TIM7.

The first selection control information DS3 is generated along with the second selection control information SDEC6, never with the second selection control information SDEC5. When the first selection control information DS3 has been generated along with the second selection control information SDEC6 like this, the 15th selector SEL15, at the timing shown in part (e) of FIG. 15, selects and sequentially outputs the to-be-currently-decoded block, shown in part (b) of FIG. 15, delayed by one sample time and fed from the 12th selector SEL12 to its D input, and the 18th selector SEL18, at the timing shown in part (e) of FIG. 15, selects and sequentially outputs the to-be-currently-decoded block, shown in part (a) of FIG. 15, fed to its D input. In this case, as shown in a "<SDEC6>" section of FIG. 14, the timing signal TIM1 is applied, as a latch signal, to the 12th latch circuit LA12 through operation of the 18th OR gate OR18 and 12th and 13th gate arrays GA12 and GA13, and the timing signal TIM1 is applied, as a latch signal, to the 14th latch circuit LA14 through operation of the 14th gate array GA14. Thus, the sample S(0) at the first sub-block of the to-be-currently-decoded block is latched into the 14th latch circuit LA14, and the sample S(*) immediately preceding the sample S(0) is latched into the 12th latch circuit LA12. Since the second selection control information SDEC6 is generated at the time of a reproduction loop return, the sample S(*) becomes a last decoded sample of the loop start block. Namely, because the first selection control information DS3 has been generated this time, the sample at the first sub-block SB1 of the to-be-currently-decoded block is made the sample $S_1$ and the sample at the fourth sub-block SB4 of the loop start block (loop-start-block RAM RAM11) is made the sample $S_0$ as shown in part (d) of FIG. 8 and part (e) of FIG. 9. The samples $S_0$ and $S_1$ thus latched in the 12th and 14th latch circuits LA12 and LA14 are output via 13th and 15th latch circuits LA13 and LA15 responsive to the timing signal TIM7, so as to be output in synchronism with each other.

When the second selection control information SDEC7 and first selection control information DS0 has been generated simultaneously, the 15th and 18th selectors SEL15 and SEL18, at the timing shown in part (e) of FIG. 15, each select and sequentially output the to-be-currently-decoded block, as shown in part (a) of FIG. 15, having been fed from the ADPCM decoder section 70 to the A input. In this case, as shown in a "<SDEC7>" section of FIG. 14, the timing signal TIM1 is applied, as a latch signal, to the 12th latch circuit LA12 through operation of the 16th inverter INV16, 12th gate array GA12 and 13th gate array GA13, and the timing signal TIM3 is applied, as a latch signal, to the 14th latch circuit LA14 through operation of the 14th gate array GA14. Thus, the sample S(0) at the first sub-block SB1 of the to-be-currently-decoded block is latched into the 12th latch circuit LA12, and the adjoining sample S(1) is latched into the 14th latch circuit LA14. Namely, because the first selection control information DS0 has been generated this time, the sample at the first sub-block SB1 of the to-be-currently-decoded block is made the sample $S_0$ and the sample at the adjoining sub-block SB2 is made the sample $S_1$ as shown in part (a) of FIG. 8 and part (f) of FIG. 9. The samples $S_0$ and $S_1$ thus latched in the 12th and 14th latch circuits LA12 and LA14 are output via the 13th and 15th latch circuits LA13 and LA15 responsive to the timing signal TIM7, so as to be output in synchronism with each other.

When the second selection control information SDEC7 and first selection control information DS1 has been generated simultaneously, the 15th and 18th selectors SEL15 and SEL18, at the timing shown in part (e) of FIG. 15, each select and sequentially output the to-be-currently-decoded block as shown in part (a) of FIG. 15, similarly to the above-mentioned. In this case, as shown in the "<SDEC7>" section of FIG. 14, the timing signal TIM3 is applied, as a latch signal, to the 12th latch circuit LA12 through operation of the 13th gate array GA13, and the timing signal TIM5 is applied, as a latch signal, to the 14th latch circuit LA14 through operation of the 14th gate array GA14. Thus, the sample S(1) of the to-be-currently-decoded block is latched into the 12th latch circuit LA12, and the adjoining sample S(2) is latched into the 14th latch circuit LA14. Namely, because the first selection control information DS1 has been generated this time, the sample at the second sub-block SB2 of the to-be-currently-decoded block is made the sample $S_0$ and the sample at the adjoining sub-block SB3 is made the sample $S_1$ as shown in part (b) of FIG. 8. The samples $S_0$ and $S_1$ thus latched in the 12th and 14th latch circuits LA12 and LA14 are output via the 13th and 15th latch circuits LA13 and LA15 responsive to the timing signal TIM7.

When the second selection control information SDEC7 and first selection control information DS2 has been generated simultaneously, the 15th and 18th selectors SEL15 and SEL18, at the timing shown in part (e) of FIG. 15, each select and sequentially output the last-decoded block as shown in part (a) of FIG. 15, similarly to the above-mentioned. In this case, as shown in the "<SDEC7>" section of FIG. 14, the timing signal TIM5 is applied, as a latch signal, to the 12th latch circuit LA12 through operation of the 13th gate array GA13, and the timing signal TIM7 is applied, as a latch signal, to the 14th latch circuit LA14 through operation of the 14th gate array GA14. Thus, the sample S(2) of the to-be-currently-decoded block is latched into the 12th latch circuit LA12, and the adjoining sample S(3) is latched into the 14th latch circuit LA14. Namely, because the first selection control information DS2 has been generated this time, the sample at the third sub-block SB3 of the to-be-currently-decoded block is made the sample $S_0$ and the sample at the adjoining sub-block SB4 is made the sample $S_1$ as shown in part (c) of FIG. 8. The samples $S_0$ and $S_1$ thus latched in the 12th and 14th latch circuits LA12 and LA14 are output via the 13th and 15th latch circuits LA13 and LA15 responsive to the timing signal TIM7.

The samples $S_0$ and $S_1$, selectively output in accordance with the combinations of the first selection control information DS0–DS3 and second selection control information SDEC1–SDEC3, SDEC5–SDEC7, are supplied to the interpolator 8, which generates interpolated samples corresponding to the decimal fraction portion data FRA of the phase information and feeds the thus-generated interpolated samples to the accumulator ACC9 as tone waveform samples S.

The following paragraphs describe a construction for feeding the quantization width Δ(n−1) to the ADPCM decoder section 70 in the ADPCM decoder 7, with reference to FIGS. 10 and 11.

As set forth above, the ADPCM tone waveform sample D(n), selectively output from the 10th selector SEL10, is also passed to the quantization width calculator section 71, where Equation (1) above is evaluated on the tone waveform sample D(n) in accordance with the quantization width Δ(n−1) selectively output from the 14th selector SEL14 to thereby generate a new quantization width Δ(n). The thus-generated quantization width Δ(n) is latched via the 16th OR gate OR16 in the 11th latch circuit LA11 at timing as dictated by the respective timing signal TIM1, TIM3, TIM5 or TIM7. The generated quantization width Δ(n) is also fed to an input terminal A of a 13th selector SEL13. The A input of the 13th selector SEL13 is selected when the second selection control information SDEC5 or SDEC6 is not being generated, and the resultant selected output from the 13th selector SEL13 is applied to a last quantization width RAM RAM12 and a loop-start quantization width RAM RAM13 in a parallel fashion.

The output from the 13th selector SEL13 is written into the last quantization width RAM RAM12 at the timing TIM7 when the return timing signal RTNT or second selection control information SDEC3 is being generated. Namely, as the stored contents of the preceding-block RAM RAM10 are updated, the quantization width A, calculated using the last sample of the RAM RAM10, is written into the last quantization width RAM RAM12. Output from the last quantization width RAM RAM12 is delivered to the 14th selector SEL14, which selects this output at the timing TIM01 when the second selection control information SDEC2 or SDEC3 is being generated and passes the selected output to the ADPCM decoder section 70 as the quantization width signal Δ(n−1). At that time, the sample at the fourth sub-block SB4 of the preceding-block RAM RAM10 is selected and output via the 12th selector SEL12 to the ADPCM decoder section 70 as the sample X(n−1).

Further, the output from the 13th selector SEL13 is written into the loop-start quantization width RAM RAM13 at the timing TIM7 when a loop-start-block-start-address detection signal LSDTCT is being generated. Namely, as the stored contents of the loop-start-block RAM RAM11 are updated, the quantization width Δ, calculated using the last sample of the loop start block, is written into the loop-start quantization width RAM RAM13. Output from the loop-start quantization width RAM RAM13 is delivered to the 14th selector SEL14, which selects this output at the timing TIM01 when the second selection control information SDEC6 or SDEC7 is being generated and passes the selected output to the ADPCM decoder section 70 as the quantization width signal Δ(n−1). At that time, the sample at the fourth sub-block SB4 of the loop-start-block RAM RAM11 is selected and output via the 12th selector SEL12 to the ADPCM decoder section 70 as the sample X(n−1).

The output from the loop-start quantization width RAM RAM13 is also fed to the B input of the 13th selector SEL13. When second selection control information SDEC5 or SDEC6 has been generated along with the return timing signal RTNT, the output from the loop-start quantization width RAM RAM13, selected by the 13th selector SEL13, is transferred to the last quantization width RAM RAM12 for renewal of the stored contents of the RAM RAM12. This renewal operation is carried out at the same time that the stored contents of the preceding-block RAM RAM10 are updated with those of the loop-start-block RAM RAM11. This allows the necessary quantization width signal Δ(n−1) to be fed to the ADPCM decoder section 70 at any given time.

The inventive waveform reproduction device using the compressed tone waveform samples has been described above as performing the loop reproduction where waveform samples as shown in FIG. 4 are repetitively reproduced; such an operational mode to perform the loop reproduction will hereinafter be called a "normal loop mode". In addition to the reproduction in the normal loop mode, the inventive waveform reproduction device using the compressed tone waveform samples is capable of reproduction of a long stream utilizing the loop reproduction function; such an operational mode to perform the long-stream reproduction will hereinafter be called a "long-stream mode".

Next, the reproduction in the long-stream mode performed in the inventive waveform reproduction device using the compressed tone waveform samples will be described with reference to FIG. 16. Note that the reproduction in the long-stream mode is performed here using at least one of the 64 channels.

Figure 16:
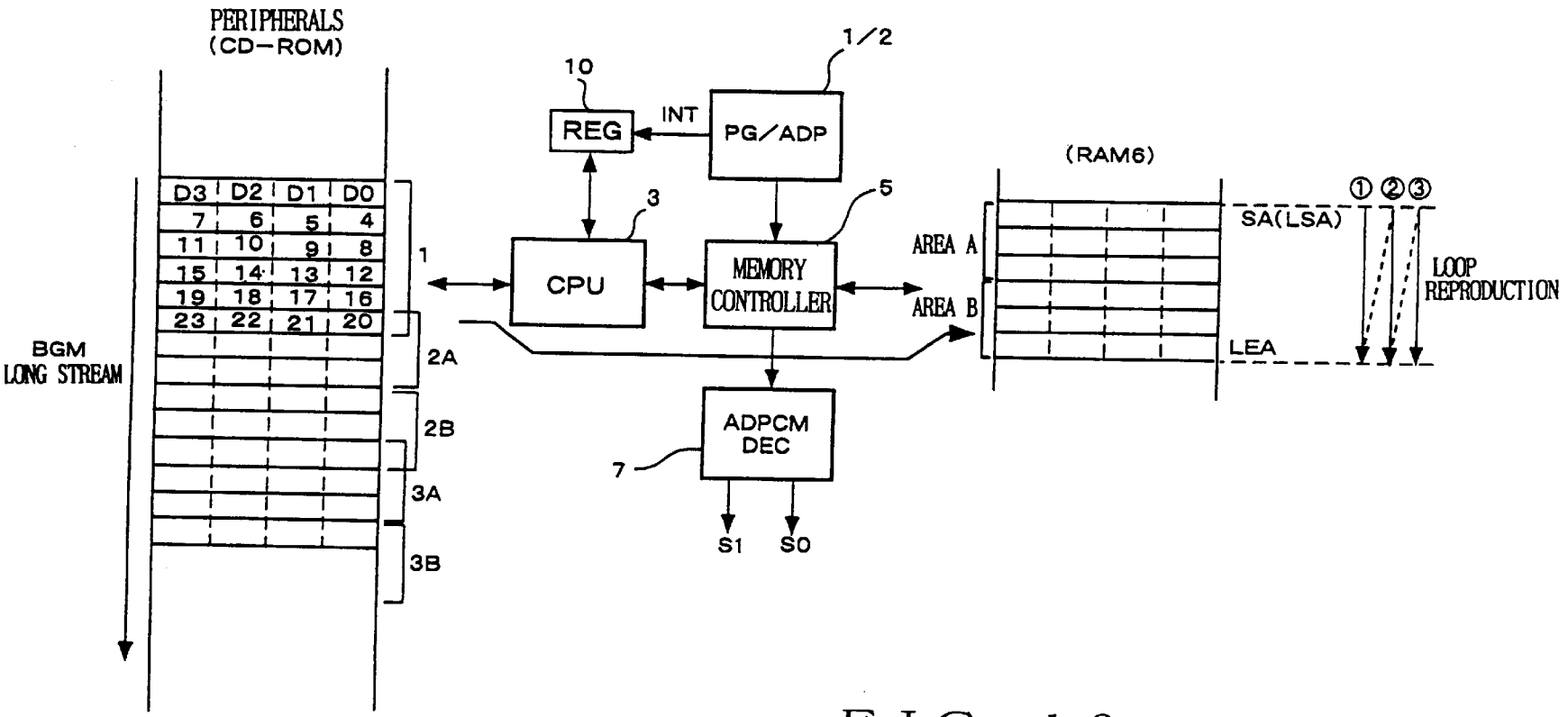
FIG. 16 is a block diagram showing an exemplary construction of the waveform reproduction device which is directed to performing long-stream reproduction.

FIG. 16 is a block diagram showing an exemplary construction of the inventive waveform reproduction device which is directed to performing the reproduction in the long-stream mode. In the long-stream mode, a long-stream portion 1, which has a data size corresponding to a total stored capacity of areas A and B provided in the RAM 6 and having a same size or capacity, is read out from a CD-ROM and stored into the areas A and B; more specifically, the ADPCM tone waveform samples of the long-stream portion 1 read out from the CD-ROM are stored into the areas A and B by the CPU 3 controlling the memory controller 5. In this instance, each of the areas A and B has a storage capacity equal to the size of three blocks (i.e., 12 ADPCM tone waveform samples). In the long-stream mode, the start address SA, which is a leading address corresponding to the leading sample in the A area, is set to be the same as the loop start address LSA, and the address corresponding to the leading sample of the last block in the B area is set as the loop end address LEA.

Then, the memory controller 5 starts sequentially reading out the ADPCM tone waveform samples at the leading address of the A area and feeds the individual read-out ADPCM tone waveform samples to the ADPCM decoder 7, which decodes the ADPCM tone waveform samples to output PCM tone waveform samples $S_0$ and $S_1$. These PCM tone waveform samples $S_0$ and $S_1$ are passed to the interpolator 8, which, in turn, generates interpolated samples corresponding to the decimal fraction portion data FRA of the phase information and feeds the thus-generated interpolated samples to the accumulator ACC9 as tone waveform samples S.

Then, once the reproduction progresses to the point where the value of the integer portion data INT has become equal to or greater than "(LEA−LSA/2)", namely, once it is detected that the last ADPCM tone waveform sample has been read out from the A area, the CPU 3 reads out a next long-stream portion 2A also comprising a total of three blocks, i.e., the block last read out from the CD-ROM (last block of the B area) and next two blocks, and stores the long-stream portion 2A into the A area of the RAM 6. The above-mentioned detection is effected by the CPU 3 monitoring contents of a register 10 where is stored the integer portion data INT of the phase information output from the phase generator PG1. Then, the ADPCM tone waveform samples of the long stream stored in the B area are sequentially read out one by one to continue the reproduction.

As the reproduction progresses to the point where it is detected that the value of the integer portion data INT has become equal to or greater than the loop end address LEA, the CPU 3 reads out next three blocks following the block last read out from the CD-ROM, and stores the next three blocks into the B area of the RAM 6. At this time, the return timing signal RTNT and return value RTNP, generated when the integer portion data INT has exceeded the loop end address LEA, are supplied from the ADPCM decoder section 70 to the phase generator PG1, so that the phase information output from the phase generator PG1 takes a value corresponding to the return value RTNP. Specifically, the phase information output from the phase generator PG1 at this time corresponds to the leading block address of the A area, and the reproduction is continued by reading out the ADPCM tone waveform samples of the next long-stream portion stored in the A area.

By thus updating, once the value of the data INT has become equal to or greater than the value "(LEA−LSA)/2", the A area so that the already-read-out last block overlaps and also repeating, once the value of the data INT has become equal to or greater than the loop end address LEA, the loop reproduction while updating the B area, the A and B areas of the RAM 6 will be alternately updated with the ADPCM tone waveform samples of new long-stream portions each having a predetermined number of the samples. With this arrangement, it is possible to reproduce a long stream composed of a great number of the samples, such as that of background music, whose all the samples can not be stored in the RAM 6.

Next, with reference to FIG. 17, a description will be made about behavior of the ADPCM decoder 7 when the first selection control information DS0–DS3 and the second selection control information SDEC1–SDEC3 has been generated during the reproduction in the long-stream mode. During the long-stream mode reproduction, generation of the second selection control information SDEC5–SDEC7 is prevented by operation of the third gate array GA3, as clearly seen from FIG. 6.

Figure 17:
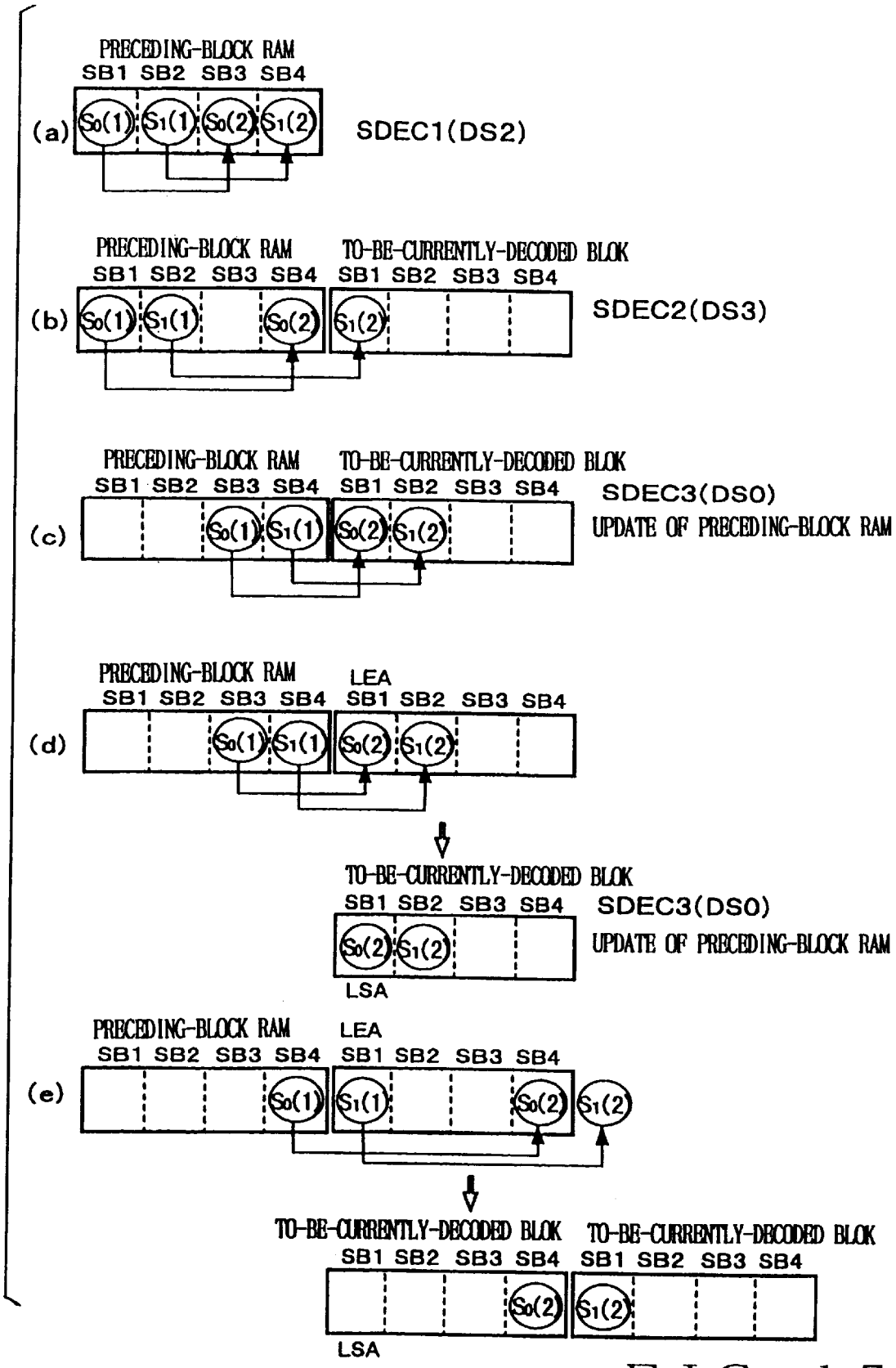
FIG. 17 is a diagram explanatory of behavior of the ADPCM decoder when second selection control information is generated during the long-stream reproduction in the waveform reproduction device of the present invention.

Operations shown in parts (a) to (c) of FIG. 17 are similar to those shown in parts (a) to (c) of FIG. 9 and hence will not described here to avoid unnecessary duplication. Part (d) of FIG. 17 shows operation of the ADPCM decoder 7 at the time of a reproduction loop return in the case where the integer portion data INT+1 has exceeded the loop end address LEA, and part (d) of FIG. 17 shows operation of the ADPCM decoder 7 in the case where the second selection control information SDEC3 and the first selection control information DS0 has been generated together while the return timing signal RTNT is generated.

In that case, last output samples $S_0(1)$ and $S_1(1)$ have been stored in the preceding-block RAM RAM10, and samples $S_0(2)$ and $S_1(2)$ to be currently output from the 15th and 18th selectors SEL15 and SEL18 are made samples of the first and second sub-blocks SB1 and SB2 of the next block. Address corresponding to the sample of the first sub-block SB1 is the loop end address LEA. Therefore, it will normally suffice to only access the RAM 6 and read out the last block of the B area; however, because the return timing signal RTNT has been generated, a memory address MA is generated this time which points to the first block of the A area corresponding to the loop start address LSA. Namely, at the time of the reproduction loop return, there arises a need to read out a succession of the ADPCM tone waveform samples from the last block of the B area to the leading block of the A area. Thus, when the area A is to be updated as shown in FIG. 16, the last block of the B area is written into the A area as its leading block in an overlapping manner.

Part (e) of FIG. 17 shows an example operation of the ADPCM decoder 7 at the time of a reproduction loop return in the case where the data INT+1 has exceeded the loop end address LEA when performing the long-stream reproduction while executing an upward pitch shift (i.e., pitch-up) process. In the illustrated example, the last selected output sample $S_0(1)$ has been stored in the preceding-block RAM RAM10, and the last output sample $S_1(1)$ is made the sample of the first sub-block SB1 of the next block and has been stored in the preceding-block RAM RAM10. Further, the sample $S_0(2)$ to be currently output from the 15th selector SEL15 is made the sample of the first sub-block SB1 of the next block while the sample $S_1(2)$ to be currently output from the 18th selector SEL18 is made the sample of the fourth sub-block SB1 of the block following the next block. Memory address corresponding to the sample of the first sub-block SB1 of the next block is the loop end address LEA. In this case too, access is made to the first block of the A area corresponding to the loop start address LSA. Whereas the ADPCM decoder 7 can be designed to read out and decode the next block, the ADPCM decoder 7 in the described preferred embodiment is not allowed to access the next block due to hardware limitations and thus can not effect the upward pitch shift or pitch-up as shown in part (e) of FIG. 17 (pitch-up across a 4-sample width, i.e., two-octave pitch-up); therefore, such a pitch-up reproduction is subject to substantial limitations. Namely, the described preferred embodiment is only capable of pitch-up across a width less than two octaves.

Although the inventive waveform reproduction device using compressed waveform samples has been so far described as generating musical tones, it may be designed to generate other sounds than the musical tones, such as effect sounds in TV games. Further, whereas the inventive waveform reproduction device has been described as being of the non-pitch-synchronized type, it is not so limited and may be constructed as the pitch-synchronized type.

Further, the inventive waveform reproduction device has been described as capable of simultaneously generating 64 tones; instead, it may be designed to simultaneously generate 128 tones or 32 tones. Furthermore, whereas the inventive waveform reproduction device has been described as permitting control of pitch-up within a range less than two octaves, it can provide for a pitch-up across two or more octaves if the hardware is designed to be able to read out two or more blocks.

Moreover, although the inventive waveform reproduction device has been described as employing the ADPCM tone waveform sample compression scheme that adaptively controls the quantization width, it may use any other suitable tone waveform sample compression schemes, such as the DPCM tone waveform sample compression scheme.

Further, although, in the described preferred embodiment, a plurality of samples of compressed waveform samples are stored per memory address, only one such sample may be stored per memory address. Furthermore, the above-described long-stream reproduction process may also be applied to a situation where normal PCM tone waveform sample data are read out from memory rather than being limited to the case where tone waveform sample data are read out from memory. Moreover, although the waveform reproduction device has been described above as constructed using hardware logic and arithmetic operation circuitry, it is not so limited and may of course be constructed using general-purpose arithmetic operation circuitry such as a computer, in which case software programs directed to that purpose may describe the waveform reproduction procedures in any appropriate programming language. In addition, the present invention can also be implemented as a medium containing a group of instructions to cause a processor, such as a computer, DSP or the like, to execute the waveform reproduction program.

Further, the preferred embodiment of the present invention has been described as performing control to read out a fixed number of the samples of compressed waveform sample data, i.e., one block or four samples; however, a variable number, rather than such a fixed number, of the samples of compressed waveform sample data may be read out per sampling cycle. In such a case, there may be read out a particular number of successive compressed waveform samples which is determined on the basis of the phase information $P_0$ (including the integer portion INT and decimal fraction portion FRA) in the current sampling cycle and the phase information $P_{-1}$ (including the integer portion INT and decimal fraction portion FRA) in the last sampling cycle; that is, it suffices to perform control such that at least a particular number of the compressed waveform samples are read out which corresponds to a difference between the phase information $P_0$ in the current sampling cycle and the phase information $P_{-1}$ in the last sampling cycle. Note that the difference between the phase information $P_0$ and $P_{-1}$ represents a pitch shift amount relative to the original pitch of the compressed waveform data stored in memory. If the difference is just "1", then the pitch of the reproduced waveform equals the original pitch. If the difference is greater than "1" but smaller than "2", the pitch of the reproduced waveform is higher than the original pitch by less than one octave. Further, if the difference is equal to or greater than "2" but smaller than "4", the pitch of the reproduced waveform is higher than the original pitch by one or more octaves but less than two octaves. Furthermore, if the difference is equal to or greater than "4" but smaller than "8", the pitch of the reproduced waveform is higher than the original pitch by two or more octaves but less than three octaves.

As an example, where the phase information $P_0$ in the current sampling cycle is "7.028" (decimal notation) and the phase information $P_{-1}$ in the last sampling cycle is "6.024" (decimal notation), the difference therebetween is an integer "1", so that one sample designated at least by the integer portion "7" of the phase information $P_0$ is read out. Because, in this case, the immediately-preceding sample necessary for the decoding has already been read out in the last sampling cycle on the basis of the phase information $P_{-1}$, the immediately-preceding sample may be used by way of a temporary storage. Of course, when interpolating arithmetic operations are to be performed in accordance with the value of the decimal fraction portion FRA of the phase information $P_0$, not only the one sample designated by the integer portion "7" (i.e., the data INT) of the phase information $P_0$ in the current sampling cycle but also the next compressed waveform sample designated by the next integer portion "8" (i.e., the data INT+1) need to be read out.

As another example, where the phase information $P_0$ in the current sampling cycle is "16.064" (decimal notation) and the phase information $P_{-1}$ in the last sampling cycle is "12.048" (decimal notation), the difference therebetween is an integer "4", so that a total of four samples, i.e., one sample designated at least by the integer portion "7" of the phase information $P_0$ plus three preceding samples (integers "15", "14" and "13") are read out. Similarly to the above-mentioned, when interpolating arithmetic operations are to be performed in accordance with the value of the decimal fraction portion FRA of the phase information $P_0$, a total of five samples, the aforementioned four samples plus one compressed waveform sample corresponding to the next integer portion "17", are read out. Because, in this case, the sample preceding and hence necessary for decoding the compressed waveform sample read out in accordance with the integer "13" has already been read out in the last sampling cycle on the basis of the integer portion "12" of the phase information $P_{-1}$ in the last sampling cycle, this preceding sample may be used by way of a temporary storage. Further, the samples decoded in the above-mentioned manner are used as the sample preceding and necessary for decoding the compressed waveform sample read out in accordance with the integer "14" (i.e., the sample corresponding to the integer "13"), as the sample preceding and necessary for decoding the sample read out in accordance with the integer "15" (i.e., the sample corresponding to the integer "14"), as the sample preceding and necessary for decoding the sample designated by the integer "16" of the current phase information $P_0$ (i.e., the sample corresponding to the integer "15"), respectively. In this example, a pitch-up across two or more octaves is permitted.

Whereas, in the described preferred embodiment, the interpolating arithmetic operations according to the decimal fraction portion FRA of the phase information are performed on two adjoining inter portions INT and INT+1, the present invention is not so limited and such interpolating arithmetic operations may be performed using three or more successive samples or three or more non-successive samples.

Further, the loop start address LSA and loop end address LEA in the long-stream reproduction need not necessarily be always fixed and may be changed as the areas of the RAM 6 for storing the long-stream portion during the long-stream reproduction are changed. Furthermore, a database for supplying the long-stream data may be any suitable type of medium other than the CD-ROM installed in the peripheral device 4, such as a transportable medium or non-transportable or fixed medium like a hard disk. Alternatively, the long-stream data may be received via a communication network from a remote database such as a server computer.

As apparent from the foregoing, the present invention arranged in the above-mentioned manner affords various superior benefits, principal ones of which are as follows. With the arrangement that the compressed waveform samples, amounting to a particular number defined by the selection control signal generated on the basis of the phase information generated by accumulating desired information, are read out and sequentially decoded one by one so that at least one decoded or decompressed waveform sample, including the latest decompressed waveform sample, is temporarily stored, the present invention can decode the compressed waveform samples sequentially one by one. Thus, even the waveform reproduction device of the non-pitch-synchronized type can reproduce a tone appropriately with a desired pitch shift.

Further, with the arrangement that the decompressed waveform sample obtained by reading out and decoding the compressed waveform sample at the loop start location is temporarily stored as the prediction value to be used at a subsequent loopback, the temporarily-stored decompressed waveform sample can be as the prediction value. Thus, even with a waveform sample storage storing compressed waveform samples each reduced in the number of bits, the present invention can appropriately reproduce a waveform through loop reproduction.

Further, by accumulating desired pitch information, every predetermined cycle, to generate phase information sequentially increasing in value from the loop start location to the loop end location, the time-divisional processing can be done with increased ease, so that a plurality of tones can be reproduced at low costs.

Furthermore, by repetitively reading out part of the tone waveform samples stored in the conventional-type waveform sample storage employed in the known tone reproduction devices, the present invention can appropriately perform a long-stream reproduction, using the loop reproduction function intended to generate sustain tones. In such a case, it is only necessary that the higher-order device supplying the long stream from outside the inventive waveform reproduction device supply the inventive waveform reproduction device with the waveforms samples of that long stream in a collective fashion; there is no need for the higher-order device to supply the waveforms samples one by one in synchronism with the reproduction rate of the waveform reproduction device. As a result, the present invention can significantly lessen the loads on the higher-order device.

Furthermore, even in the case where the long stream is made up of compressed waveform samples, the long stream of the compressed waveform samples can be decoded by use of the decoder that is provided to allow the waveform reproduction device to reproduce compressed waveform samples, and thus the present invention can eliminate the need for a decoder dedicated to the long-stream reproduction.

What is claimed is:

1. A waveform reproduction device comprising:

a memory that stores compressed waveform samples based on a predetermined data compression scheme;

a phase generator that generates, every sampling cycle, progressive phase information varying in accordance with a tone pitch to be reproduced;

a readout controller that sequentially reads out the compressed waveform samples from said memory on the basis of the phase information generated by said phase generator, said readout controller controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle;

a compression decoder that decodes each of the compressed waveform samples read out from said memory using a predetermined prediction value;

a buffer that supplies said compression decoder with a previously decoded waveform sample as the predetermined prediction value, to thereby allow said compression decoder to decode all the compressed waveform samples read out from said memory; and an output section that selects and outputs, from among the waveform samples decoded by said compression decoder, a decoded waveform sample corresponding to the phase information of the current sampling cycle.

2. A waveform reproduction device as recited in claim 1 wherein said phase generator generates the progressive phase information by calculating, every predetermined sampling cycle, a phase variation value corresponding to the tone pitch to be reproduced.

3. A waveform reproduction device as recited in claim 1 wherein said buffer includes a storage for temporarily storing at least one of the waveform samples decoded by said compression decoder.

4. A waveform reproduction device as recited in claim 1 wherein said buffer includes a storage for temporarily storing a latest one of the waveform samples decoded by said compression decoder.

5. A waveform reproduction device as recited in claim 1 wherein said readout controller controls the readout of the compressed waveform samples so that all the compressed waveform samples existing between one compressed waveform sample corresponding to the phase information of the last sampling cycle and another compressed waveform sample corresponding to the phase information of the current sampling cycle are read out from said memory at least by the current sampling cycle.

6. A waveform reproduction device as recited in claim 1 wherein said readout controller controls the readout of the compressed waveform samples so that a plurality of the compressed waveform samples before and/or after the compressed waveform sample corresponding to the phase information of the current sampling cycle are read out in the current sampling cycle.

7. A waveform reproduction device as recited in claim 1 wherein said readout controller reads out, from said memory, successive compressed waveform samples that amount to a particular number defined on the basis of both the phase information generated by said phase generator in the current and last sampling cycles.

8. A waveform reproduction device as recited in claim 1 wherein said memory has stored therein n, which is an integral number of two or over, successive compressed waveform samples per address, said readout controller performs, every sampling cycle, either control for reading out the n compressed waveform samples from said memory by accessing one address of said memory in accordance with the phase information or control for not accessing said memory at all;

said compression decoder decodes the n compressed waveform samples read out from said memory in one sampling cycle; and said buffer includes a storage for storing n decoded waveform samples output by said compression decoder at least till a next sampling cycle, the n decoded waveform samples stored in said storage being usable as the prediction value for decoding by said compression decoder in the next sampling cycle and also as waveform samples to be output via said output section in response to the phase information of the next sampling cycle.

9. A waveform reproduction device as recited in claim 1 wherein a total number of the compressed waveform samples which can be read out, by said readout controller, from said memory per sampling cycle is n that is an integral number of two or over, and wherein an upper limit to a pitch-up process for reproducing a waveform of a higher pitch than an original pitch of a waveform stored in said memory is controlled in accordance with the number n.

10. A waveform reproduction device as recited in claim 1 wherein the phase information generated by said phase generator is composed of an integer portion and a decimal fraction portion, and wherein said output section selects at least two of the waveform samples on the basis of the integer portion of the phase information and performs interpolating arithmetic operations, in accordance with the decimal fraction portion of the phase information, using the selected at least two waveform samples, to thereby generate the waveform sample corresponding to the phase information of the current sampling cycle.

11. A waveform reproduction device as recited in claim 1 wherein the compressed waveform samples stored in said memory are compression-coded on the basis of a differential pulse code modulation scheme or an adaptive differential pulse code modulation scheme.

12. A waveform reproduction device as recited in claim 1 which is capable of reproducing a plurality of waveforms by time-divisionally decoding the compressed waveform samples in a plurality of reproduction channels.

13. A method of reproducing, from a memory storing compressed waveform samples based on a predetermined data compression scheme, a waveform of a higher pitch than an original pitch, said method comprising:

a step of generating, every sampling cycle, progressive phase information varying in accordance with a tone pitch to be reproduced;

a step of sequentially reading out the compressed waveform samples from said memory on the basis of the phase information generated by said step of generating, said step of sequentially reading controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle;

a step of decoding each of the compressed waveform samples read out from said memory using a predetermined prediction value;

a step of supplying said step of decoding with a previously decoded waveform sample as the predetermined prediction value for decoding of a following compressed waveform sample, to thereby allow said step of decoding to decode all the compressed waveform samples read out from said memory; and a step of selecting and outputting, from among the waveform samples decoded by said step of decoding, a decoded waveform sample corresponding to the phase information of the current sampling cycle.

14. A machine-readable medium containing a group of instructions of a program executable by a processor to perform a waveform reproduction process, said waveform reproduction process being directed to reproducing, from a memory storing compressed waveform samples based on a predetermined data compression scheme, a waveform of a higher pitch than an original pitch, said program comprising:

a step of generating, every sampling cycle, progressive phase information varying in accordance with a tone pitch to be reproduced;

a step of sequentially reading out the compressed waveform samples from said memory on the basis of the phase information generated by said step of generating, said step of sequentially reading controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle;

a step of decoding each of the compressed waveform samples read out from said memory using a predetermined prediction value;

a step of supplying said step of decoding with a previously decoded waveform sample as the predetermined prediction value for decoding of a following compressed waveform sample, to thereby allow said step of decoding to decode all the compressed waveform samples read out from said memory; and a step of selecting and outputting, from among the waveform samples decoded by said step of decoding, a decoded waveform sample corresponding to the phase information of the current sampling cycle.

15. A waveform reproduction device comprising:

a memory that stores compressed waveform samples based on a predetermined data compression scheme;

a readout controller that generates an address signal advancing at a given reproduction rate in order to read out the compressed waveform samples from said memory, said readout controller controlling loop readout of the compressed waveform samples by repeating an advance of the address signal between a given loop start location and a given loop end location;

a compression decoder that decodes each of the compressed waveform samples read out from said memory, using a prediction value; and a storage that stores a waveform sample generated by said compression decoder decoding the compressed waveform sample corresponding to the loop start location, wherein when the advance of the address signal returns from the loop end location to the loop start location, said storage supplies the stored waveform sample to said compression decoder for use as the prediction value.

16. A waveform reproduction device as recited in claim 15 wherein the loop start location and loop end location are designated by information indicative of the loop start location and information indicative of the loop end location, respectively, and said readout controller repeats the advance of the address signal between the loop start location and the loop end location indicated by respective one of the information.

17. A waveform reproduction device as recited in claim 15 wherein said memory has stored therein n, which is an integral number of two or over, successive compressed waveform samples per address, said readout controller performs, every sampling cycle, either control for reading out the n compressed waveform samples from said memory by accessing one address of said memory or control for not accessing said memory at all;

said compression decoder decodes the n compressed waveform samples read out from said memory in one sampling cycle; and said storage stores at least n decoded waveform samples output by said compression decoder, said n decoded waveform samples including the loop start location.

18. A waveform reproduction device comprising:

a memory that stores compressed waveform samples based on a predetermined data compression scheme;

a phase generator that generates, every sampling cycle, progressive phase information varying in accordance with a tone pitch to be reproduced, said phase generator controlling loop reproduction by repeating an advance of the phase information between a given loop start location and a given loop end location;

a readout controller that sequentially reads out the compressed waveform samples from said memory on the basis of the phase information generated by said phase generator, said readout controller controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle;

a compression decoder that decodes each of the compressed waveform samples read out from said memory, using a predetermined prediction value;

a buffer that supplies said compression decoder with a previously decoded waveform sample as the predetermined prediction value, to thereby allow said compression decoder to decode all the compressed waveform samples read out from said memory;

a storage that stores a waveform sample generated by said compression decoder decoding the compressed waveform sample corresponding to the loop start location, wherein when the advance of the phase information returns from the loop end location to the loop start location, said storage supplies the stored waveform sample to said compression decoder for use as the prediction value; and an output section that selects and outputs, from among the waveform samples decoded by said compression decoder, a decoded waveform sample corresponding to the phase information of the current sampling cycle.

19. A waveform reproduction device as recited in claim 18 wherein said phase generator generates the progressive phase information by calculating, every predetermined sampling cycle, a phase variation value corresponding to the tone pitch to be reproduced.

20. A waveform reproduction device as recited in claim 18 wherein said output section selects the decoded waveform sample corresponding to the phase information of the current sampling cycle from any one of said decoder, buffer and storage.

21. A waveform reproduction device as recited in claim 18 wherein said memory has stored therein n, which is an integral number of two or over, successive compressed waveform samples per address, said readout controller performs, every sampling cycle, either control for reading out the n compressed waveform samples from said memory by accessing one address of said memory or control for not accessing said memory at all;

said compression decoder decodes the n compressed waveform samples read out from said memory in one sampling cycle; and said storage stores at least n decoded waveform samples output by said compression decoder, said n decoded waveform samples including the loop start location.

22. A waveform reproduction device as recited in claim 18 wherein the phase information generated by said phase generator is composed of an integer portion and a decimal fraction portion, and wherein said output section selects at least two of the waveform samples on the basis of the integer portion of the phase information and performs interpolating arithmetic operations, in accordance with the decimal fraction portion of the phase information, using the selected at least two waveform samples, to thereby generate the waveform sample corresponding to the phase information of the current sampling cycle.

23. A waveform reproduction device as recited in claim 18 wherein the compressed waveform samples stored in said memory are compression-coded on the basis of a differential pulse code modulation scheme or an adaptive differential pulse code modulation scheme.

24. A waveform reproduction device as recited in claim 18 which is capable of reproducing a plurality of waveforms by time-divisionally decoding the compressed waveform samples in a plurality of reproduction channels.

25. A method of performing loop reproduction of a waveform from a memory storing compressed waveform samples based on a predetermined data compression scheme, said method comprising:

a step of generating an address signal advancing at a given reproduction rate in order to read out the compressed waveform samples from said memory, said step of generating controlling loop readout of the compressed waveform samples by repeating an advance of the address signal between a given loop start location and a given loop end location;

a step of decoding each of the compressed waveform samples read out from said memory, using a prediction value; and a step of storing a waveform sample generated by decoding the compressed waveform sample corresponding to the loop start location, wherein when the advance of the address signal returns from the loop end location to the loop start location, said step of storing supplies the stored waveform sample to said step of decoding for use as the prediction value.

26. A machine-readable medium containing a group of instructions of a program executable by a processor to perform a waveform reproduction process, said waveform reproduction process being directed to performing loop reproduction of a waveform from a memory storing compressed waveform samples based on a predetermined data compression scheme, said program comprising:

a step of generating an address signal advancing at a given reproduction rate in order to read out the compressed waveform samples from said memory, said step of generating controlling loop readout of the compressed waveform samples by repeating an advance of the address signal between a given loop start location and a given loop end location;

a step of decoding each of the compressed waveform samples read out from said memory, using a prediction value; and a step of storing a waveform sample generated by decoding the compressed waveform sample corresponding to the loop start location, wherein when the advance of the address signal returns from the loop end location to the loop start location, said step of storing supplies the stored waveform sample to said step of decoding for use as the prediction value.

27. A method of reproducing a waveform from a memory storing compressed waveform samples based on a predetermined data compression scheme, said method comprising:

a step of generating, every sampling cycle, progressive phase information varying in accordance with a tone pitch to be reproduced, said step of generating controlling loop reproduction by repeating an advance of the phase information between a given loop start location and a given loop end location;

a step of sequentially reading out the compressed waveform samples from said memory on the basis of the phase information generated by said step of generating, said step of sequentially reading controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle;

a step of decoding each of the compressed waveform samples read out from said memory, using a predetermined prediction value;

a step of supplying said step of decoding with a previously decoded waveform sample as the predetermined prediction value, to thereby allow said step of decoding to decode all the compressed waveform samples read out from said memory;

a step of storing a waveform sample generated by decoding the compressed waveform sample corresponding to the loop start location, wherein when the advance of the phase information returns from the loop end location to the loop start location, said step of storing supplies the stored waveform sample to said step of decoding for use as the prediction value; and a step of selecting and outputting, from among the waveform samples decoded by said step of decoding, a decoded waveform sample corresponding to the phase information of the current sampling cycle.

28. A machine-readable medium containing a group of instructions of a program executable by a processor to perform a waveform reproduction process, said waveform reproduction process being directed to reproducing a waveform from a memory storing compressed waveform samples based on a predetermined data compression scheme, said program comprising:

a step of generating, every sampling cycle, progressive phase information varying in accordance with a tone pitch to be reproduced, said step of generating controlling the loop reproduction by repeating an advance of the phase information between a given loop start location and a given loop end location;

a step of sequentially reading out the compressed waveform samples from said memory on the basis of the phase information generated by said step of generating, said step of sequentially reading controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle;

a step of decoding each of the compressed waveform samples read out from said memory, using a predetermined prediction value;

a step of supplying said step of decoding with a previously decoded waveform sample as the predetermined prediction value, to thereby allow said step of decoding to decode all the compressed waveform samples read out from said memory;

a step of storing a waveform sample generated by decoding the compressed waveform sample corresponding to the loop start location, wherein when the advance of the phase information returns from the loop end location to the loop start location, said step of storing supplies the stored waveform sample to said step of decoding for use as the prediction value; and a step of selecting and outputting, from among the waveform samples decoded by said step of decoding, a decoded waveform sample corresponding to the phase information of the current sampling cycle.

29. A waveform reproduction device comprising:

a readable and writable memory that stores partial long-stream data constituting part of a long stream of sound waveform samples;

a readout controller that generates an address signal advancing at a given reproduction rate in order to read out the waveform samples from said memory, said readout controller repeating an advance of the address signal between a start location and an end location of a particular region of said memory which stores the partial long-stream data, to thereby perform loop readout of said region; and a memory rewrite controller that, before the advance of the address signal returns from the end location to the start location, rewrites the waveform samples from the start location to the end location of the region of said memory, already read out via said readout controller, with a next partial long stream stored in said memory.

30. A waveform reproduction device as recited in claim 29 wherein the loop location and the end location are designated by information indicative of the start location and information indicative of the end location, respectively, and said readout controller repeats the advance of the address signal between the start location and the loop end location indicated by respective one of the information.

31. A waveform reproduction device as recited in claim 29 wherein said memory rewrite controller controls rewrite of the partial long stream in such a way that the waveform sample corresponding to the start location in the next partial long stream overlaps the waveform sample corresponding to the end location in a partial long stream preceding said next partial long stream.

32. A waveform reproduction device as recited in claim 29 wherein the region of said memory between the start location and the end location is divided into a first area and a second area, and wherein said memory rewrite controller writes a next partial long stream into said first area after the advance of the address signal has shifted from said first area to said second area and writes a further next partial long stream into said second area after the advance of the address signal has returned from said second area to said first area.

33. A waveform reproduction device comprising:

a readable and writable memory that stores partial long-stream data constituting part of a long stream of compressed waveform samples based on a predetermined data compression scheme;

a phase generator that generates, every sampling cycle, progressive phase information varying at a given reproduction rate, said readout controller repeating an advance of the phase information between a start location and an end location of a particular region of said memory which stores the partial long-stream data, to thereby perform loop readout of said region;

a readout controller that sequentially reads out the compressed waveform samples from said memory on the basis of the phase information generated by said phase generator, said readout controller controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle;

a compression decoder that decodes each of the compressed waveform samples read out from said memory, using a predetermined prediction value;

a buffer that supplies said compression decoder with a previously decoded waveform sample as the predetermined prediction value, to thereby allow said compression decoder to decode all the compressed waveform samples read out from said memory;

an output section that selects and outputs, from among the waveform samples decoded by said compression decoder, a decoded waveform sample corresponding to the phase information of the current sampling cycle; and a memory rewrite controller that, before an advance of the phase information returns from the end location to the start location, rewrites the waveform samples from the start location to the end location of the region of said memory, already read out via said readout controller, with a next partial long stream stored in said memory.

34. A waveform reproduction device as recited in claim 33 wherein said memory rewrite controller controls rewrite of the partial long stream in such a way that the compressed waveform sample corresponding to the start location in the next partial long stream overlaps the compressed waveform sample corresponding to the end location in a partial long stream preceding said next partial long stream.

35. A waveform reproduction device as recited in claim 33 wherein the region of said memory between the start location and the end location is divided into a first area and a second area, and wherein said memory rewrite controller writes a next partial long stream into said first area after the advance of the phase information has shifted from said first area to said second area and writes a further next partial long stream into said second area after the advance of the phase information has returned from said second area to said first area.

36. A waveform reproduction device as recited in claim 33 wherein said memory rewrite controller reads out a necessary partial long stream from a database storing a long stream of compressed waveform samples and writes the necessary partial long stream into said memory.

37. A waveform reproduction device as recited in claim 33 wherein the phase information generated by said phase generator is composed of an integer portion and a decimal fraction portion, and wherein said output section selects at least two of the waveform samples on the basis of the integer portion of the phase information and performs interpolating arithmetic operations, in accordance with the decimal fraction portion of the phase information, using the selected at least two waveform samples, to thereby generate the waveform sample corresponding to the phase information of the current sampling cycle.

38. A waveform reproduction device as recited in claim 33 wherein said phase generator generates the progressive phase information by calculating, every predetermined sampling cycle, a phase variation value corresponding to the reproduction rate.

39. A waveform reproduction device as recited in claim 33 wherein said memory has stored therein n, which is an integral number of two or over, successive compressed waveform samples per address, said readout controller performs, every sampling cycle, either control for reading out the n compressed waveform samples from said memory by accessing one address of said memory in accordance with the phase information or control for not accessing said memory at all;

said compression decoder decodes the n compressed waveform samples read out from said memory in one sampling cycle; and said buffer includes a storage for storing n decoded waveform samples output by said compression decoder at least till a next sampling cycle, the n decoded waveform samples stored in said storage being usable as the prediction value for decoding by said compression decoder in the next sampling cycle and also as waveform samples to be output via said output section in response to the phase information of the next sampling cycle.

40. A waveform reproduction device as recited in claim 33 wherein the compressed waveform samples stored in said memory are compression-coded on the basis of a differential pulse code modulation scheme or an adaptive differential pulse code modulation scheme.

41. A method of reproducing a long stream of sound waveform samples by writing, into a readable and writable memory, partial long-stream data constituting part of the long stream of sound waveform samples and repeating read and write of the partial long-stream data on said memory, said method comprising:

a step of generating an address signal advancing at a given reproduction rate in order to read out the waveform samples from said memory, said step of generating repeating an advance of the address signal between a start location and an end location of a particular region of said memory storing the partial long stream data to thereby perform loop readout of said region; and a step of, before the advance of the address signal returns from the end location to the start location, rewriting the waveform samples, already read out from the start location to the end location of the region of said memory, with a next partial long stream stored in said memory.

42. A machine-readable medium containing a group of instructions of a program executable by a processor to perform a long-stream reproduction process on sound waveform samples, said long-stream reproduction process being directed to reproducing a long stream of sound waveform samples by writing, into a readable and writable memory, partial long-stream data constituting part of the long stream of sound waveform samples and repeating read and write of the partial long-stream data on said memory, said program comprising:

a step of generating an address signal advancing at a given reproduction rate in order to read out the waveform samples from said memory, said step of generating repeating an advance of the address signal between a start location and an end location of a particular region of said memory storing the partial long stream data, to thereby perform loop readout of said region; and a step of, before the advance of the address signal returns from the end location to the start location, rewriting the waveform samples, already read out from the start location to the end location of the region of said memory, with a next partial long stream stored in said memory.

43. A method of reproducing a long stream of sound waveform samples by writing, into a readable and writable memory, partial long-stream data constituting part of the long stream of compressed waveform samples based on a predetermined data compression scheme and repeating read and write of the partial long-stream data on said memory, said method comprising:

a step of generating, every sampling cycle, progressive phase information varying at a given reproduction rate, said readout controller repeating an advance of the phase information between a start location and an end location of a region of said memory storing the partial long-stream data, to thereby perform loop readout of said region;

a step of sequentially reading out the compressed waveform samples from said memory on the basis of the phase information generated by said step of generating, said sequentially reading controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle;

a step of decoding each of the compressed waveform samples read out from said memory, using a predetermined prediction value;

a step of supplying said step of decoding with a previously decoded waveform sample as the predetermined prediction value, to thereby allow said step of decoding to decode all the compressed waveform samples read out from said memory;

a step of selecting and outputting, from among the waveform samples decoded by said step of decoding, a decoded waveform sample corresponding to the phase information of the current sampling cycle; and a step of, before an advance of the phase information returns from the end location to the start location, rewriting the waveform samples, already read out from the start location to the end location of the region of said memory, with a next partial long stream stored in said memory.

44. A machine-readable medium containing a group of instructions of a program executable by a processor to perform a long-stream reproduction process on sound waveform samples, said long-stream reproduction process being directed to reproducing a long stream of sound waveform samples by writing, into a readable and writable memory, partial long-stream data constituting part of the long stream of compressed waveform samples based on a predetermined data compression scheme and repeating read and write of the partial long-stream data on said memory, said program comprising:

a step of generating, every sampling cycle, progressive phase information varying at a given reproduction rate, said readout controller repeating an advance of the phase information between a start location and an end location of a region of said memory storing the partial long-stream data, to thereby perform loop readout of said region;

a step of sequentially reading out the compressed waveform samples from said memory on the basis of the phase information generated by said step of generating, said sequentially reading controlling readout of the compressed waveform samples so as to provide successive compressed waveform samples from the compressed waveform sample corresponding to the phase information generated in a last sampling cycle to the compressed waveform sample corresponding to the phase information generated in a current sampling cycle;

a step of decoding each of the compressed waveform samples read out from said memory, using a predetermined prediction value;

a step of supplying said step of decoding with a previously decoded waveform sample as the predetermined prediction value, to thereby allow said step of decoding to decode all the compressed waveform samples read out from said memory;

a step of selecting and outputting, from among the waveform samples decoded by said step of decoding, a decoded waveform sample corresponding to the phase information of the current sampling cycle; and a step of, before an advance of the phase information returns from the end location to the start location, rewriting the waveform samples, already read out from the start location to the end location of the region of said memory, with a next partial long stream stored in said memory.

* * * * *